US011612244B2

(12) United States Patent
Choi

(10) Patent No.: US 11,612,244 B2
(45) Date of Patent: Mar. 28, 2023

(54) PORTABLE STRUCTURE WITH HANDLE

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 141 days.

(21) Appl. No.: 17/246,038

(22) Filed: Apr. 30, 2021

(65) Prior Publication Data

US 2021/0345776 A1 Nov. 11, 2021

(30) Foreign Application Priority Data

May 8, 2020 (CN) ..... 202020746761.2
Sep. 10, 2020 (CN) ..... 202021973418.8
Feb. 7, 2021 (CN) ..... 202120358132.7

(51) Int. Cl.

| | |
|---|---|
| ***A47B 95/02*** | (2006.01) |
| ***A47B 3/087*** | (2006.01) |
| ***A47B 96/00*** | (2006.01) |
| ***A47B 3/083*** | (2006.01) |
| ***A47B 13/08*** | (2006.01) |
| ***A47C 31/00*** | (2006.01) |
| ***A47C 7/62*** | (2006.01) |

(52) U.S. Cl.

CPC ..... *A47B 95/02* (2013.01); *A47B 3/083* (2013.01); *A47B 3/087* (2013.01); *A47B 13/08* (2013.01); *A47B 96/00* (2013.01); *A47B 2220/0047* (2013.01); *A47C 7/62* (2013.01); *A47C 31/00* (2013.01)

(58) Field of Classification Search

CPC .. A47B 13/08; A47B 95/02; A47B 2220/0047
See application file for complete search history.

(56) References Cited

U.S. PATENT DOCUMENTS

| | | | |
|---|---|---|---|
| 737,455 | A | 8/1903 | Noble |
| 922,179 | A | 5/1909 | Nolan |
| 1,063,642 | A | 6/1913 | Birdsell |
| 1,911,750 | A | 5/1933 | Collignon |
| 2,136,569 | A | 11/1938 | Trimpi |
| 2,325,182 | A | 7/1943 | Fitzpatrick |
| 2,730,418 | A | 1/1956 | Blink |

(Continued)

FOREIGN PATENT DOCUMENTS

| | | | |
|---|---|---|---|
| CN | 109431070 | A | 3/2019 |
| EP | 1492432 | B1 | 10/2016 |

(Continued)

*Primary Examiner* — Daniel J Rohrhoff
(74) *Attorney, Agent, or Firm* — Morgan, Lewis & Bockius LLP

(57) ABSTRACT

A portable structure includes a main body, a ridge coupled or formed with the main body and a supporting assembly with a mounting bar disposed adjacent to the ridge. The portable structure also includes a handle coupled to one or more of the ridge, main body and mounting bar by first and second connectors. Each connector includes a first connecting piece connected to the ridge and a second connecting piece coupled or formed with the first connecting piece. The handle includes first and second attachment portions connected to the first and second connectors, respectively, and a gripping portion between the first and second attachment portions to facilitate grasping of the handle.

25 Claims, 32 Drawing Sheets

(56) References Cited

U.S. PATENT DOCUMENTS

| | | | | |
|---|---|---|---|---|
| 2,766,089 | A | 10/1956 | Nielsen | |
| 2,803,033 | A | 8/1957 | Rachman | |
| 2,811,400 | A | 10/1957 | James | |
| 3,075,809 | A | 1/1963 | Wilson | |
| 3,080,834 | A | 3/1963 | Newell | |
| 3,140,674 | A | 7/1964 | Cisler | |
| 3,304,891 | A | 2/1967 | Rachman | |
| 3,368,504 | A | 2/1968 | Cohen | |
| 3,410,232 | A | 11/1968 | Bills | |
| 4,191,111 | A | 3/1980 | Emmert | |
| 4,489,661 | A | 12/1984 | Fitzgerald | |
| 5,325,794 | A | 7/1994 | Hontani | |
| 6,508,262 | B1 | 1/2003 | Takayama | |
| 6,752,091 | B2 * | 6/2004 | Glover | A47B 3/087 108/169 |
| 6,843,183 | B2 | 1/2005 | Strong | |
| 7,059,254 | B2 | 6/2006 | Strong et al. | |
| 7,096,799 | B2 | 8/2006 | Strong et al. | |
| 7,097,380 | B2 | 8/2006 | Lee | |
| 7,171,910 | B2 | 2/2007 | Neunzert et al. | |
| 7,428,872 | B2 | 9/2008 | Strong et al. | |
| 7,475,643 | B2 | 1/2009 | Haney et al. | |
| 7,475,644 | B2 | 1/2009 | Strong et al. | |
| 7,634,969 | B2 | 12/2009 | Neunzert et al. | |
| 7,640,870 | B2 | 1/2010 | Strong et al. | |
| 7,644,667 | B2 | 1/2010 | Strong et al. | |
| 7,735,431 | B2 | 6/2010 | Neunzert et al. | |
| 7,874,303 | B2 | 1/2011 | Xie | |
| 8,006,630 | B2 | 8/2011 | Strong et al. | |
| 8,033,228 | B2 | 10/2011 | Haney et al. | |
| 8,042,475 | B2 | 10/2011 | Larcom et al. | |
| 8,156,875 | B2 | 4/2012 | Neunzert et al. | |
| 8,166,894 | B1 * | 5/2012 | Branch | A47B 3/087 108/169 |
| 8,302,541 | B2 | 11/2012 | Haney et al. | |
| 8,342,107 | B2 | 1/2013 | Mover et al. | |
| 8,534,205 | B1 | 9/2013 | Johnson et al. | |
| 8,578,865 | B2 | 11/2013 | Haney et al. | |
| 8,622,007 | B2 | 1/2014 | Peery et al. | |
| 8,746,155 | B2 | 6/2014 | Haney et al. | |
| 8,757,069 | B2 | 6/2014 | Peery et al. | |
| 9,027,952 | B2 | 5/2015 | Zhu | |
| D748,418 | S | 2/2016 | Johnson et al. | |
| 9,277,808 | B2 | 3/2016 | Cai et al. | |
| D756,694 | S | 5/2016 | Johnson et al. | |
| 9,351,563 | B2 | 5/2016 | Bennett et al. | |
| 9,462,880 | B1 | 10/2016 | Lin | |
| 10,470,561 | B2 | 11/2019 | Clegg et al. | |
| 10,602,852 | B2 | 3/2020 | Choi | |
| 2003/0089286 | A1 | 5/2003 | Wang | |
| 2004/0187749 | A1 | 9/2004 | Zhurong | |
| 2005/0097829 | A1 | 5/2005 | Seo | |
| 2005/0120923 | A1 | 6/2005 | Sagol | |
| 2005/0241551 | A1 * | 11/2005 | Neunzert | F16B 12/24 108/132 |
| 2006/0062632 | A1 | 3/2006 | Jang | |
| 2007/0101910 | A1 | 5/2007 | Haimoff | |
| 2008/0078310 | A1 | 4/2008 | VanNimwegen | |
| 2008/0202390 | A1 * | 8/2008 | Branch | A47B 3/087 108/43 |
| 2010/0242809 | A1 * | 9/2010 | Neunzert | F16B 12/24 108/50.11 |
| 2012/0199050 | A1 * | 8/2012 | Neunzert | A47B 3/0915 108/50.11 |
| 2012/0210915 | A1 * | 8/2012 | Branch | A47B 3/087 211/27 |
| 2013/0000528 | A1 | 1/2013 | Jin | |
| 2013/0025507 | A1 | 1/2013 | Jin | |
| 2013/0233210 | A1 | 9/2013 | Jin | |
| 2014/0030012 | A1 | 1/2014 | Lee | |
| 2014/0099155 | A1 | 4/2014 | Chen | |
| 2014/0130837 | A1 | 5/2014 | Sy-Facunda | |
| 2014/0345506 | A1 | 11/2014 | Clegg | |
| 2016/0227919 | A1 | 8/2016 | Turner | |
| 2016/0348395 | A1 | 12/2016 | Jin | |
| 2017/0013955 | A1 * | 1/2017 | Lin | A47B 3/087 |
| 2018/0153302 | A1 | 6/2018 | Jiang | |
| 2019/0150608 | A1 | 5/2019 | Johnson et al. | |
| 2019/0284831 | A1 | 9/2019 | Volin | |
| 2019/0292808 | A1 | 9/2019 | Dotterweich | |
| 2020/0390233 | A1 | 12/2020 | Leng | |
| 2021/0222823 | A1 | 7/2021 | Choi | |
| 2021/0345776 | A1 | 11/2021 | Choi | |

FOREIGN PATENT DOCUMENTS

| | | | |
|---|---|---|---|
| GB | 2192534 | A | 1/1988 |
| WO | WO 2011097404 | A1 | 8/2011 |
| WO | WO 2013000149 | A1 | 1/2013 |

* cited by examiner

PORTABLE STRUCTURE WITH HANDLE

CROSS-REFERENCE TO RELATED APPLICATIONS

The present application claims priority to Chinese Utility Model Applications CN 202020746761.2 filed May 8, 2020, CN 202021973418.8 filed Sep. 10, 2020, and CN 202120358132.7 filed Feb. 7, 2021. The disclosure of each application is incorporated herein for all purposes by reference in its entirety.

FIELD OF THE INVENTION

The present invention generally relates to portable structures and, in particular, to portable structures with handles.

BACKGROUND

Portable tables and chairs are desired for outdoor activities. At present, some existing portable tables and chairs are not equipped with handles, so they are difficult to carry around. Some are equipped with handles. However, the connection of the handles in these portable tables or chairs is not optimally configured and high local stress is often generated during use. High local stress can cause damages to tables and chairs, especially to those components around the handle connection. This will inevitably shorten the service life of the product and may cause safety issues.

Given the current state of the art, there remains a need for portable structures such as portable tables and chairs that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides portable structures with reduced local stresses and enhanced connection strength.

In various exemplary embodiments, the present disclosure provides a portable structure including a main body, a ridge, first and second connectors, and a handle. The main body has a first body surface and a second body surface. The ridge is coupled or formed with the main body and extended in a first direction beyond the first body surface. Each of the first and second connectors includes a first connecting piece connected to the ridge, a handle connecting piece coupled or formed with the first connecting piece, and at least one opening to allow access of the handle connecting piece from an outside. The handle includes a first attachment portion, a second attachment portion and a gripping portion. The first attachment portion passes through the at least one opening of the first connector and, cross-sectional-wise, surrounds the handle connecting piece of the first connector. The second attachment portion passes through the at least one opening of the second connector and, cross-sectional-wise, surrounds the handle connecting piece of the second connector. The gripping portion is disposed between the first and second attachment portions to facilitate grasping of the handle.

In an exemplary embodiment, the handle includes a strap made of a flexible material. The first attachment portion of the handle is formed from a first end portion of the strap and the second attachment portion of the handle is formed from a second end portion of the strap.

In some exemplary embodiments, the ridge is formed with a first notch and a second notch, with the first connector disposed at the first notch and the second connector disposed at the second notch.

In some exemplary embodiments, a first lug is formed at a first side of the first notch, and a second lug is formed at a second side of the first notch. The first connecting piece of the first connector is formed with a first slot to receive the first lug and a second slot to receive the second lug, and the first connecting piece of the first connector is fixedly coupled with the first and second lugs at the first notch of the ridge.

In some exemplary embodiments, the handle connecting piece of the first connector is disposed between the first and second slots of the first connecting piece of the first connector. The first and second lugs at the first notch are spaced apart from each other, thereby creating a space in between to accommodate the handle connecting piece of the first connector.

In some exemplary embodiments, the ridge includes an exterior ridge surface, an interior ridge surface spaced apart from the exterior ridge surface, a top ridge surface connecting the exterior and interior ridge surfaces, and a height measured from the top ridge surface to the first body surface. The first notch includes a notch depth, measured from the top ridge surface to a bottom surface of the first notch, that is smaller than the height of the ridge. A first ridge recess is formed adjacent to the first notch and the first body surface of the main body, and recessed from the interior ridge surface toward the exterior ridge surface. A first body recess is formed adjacent to the first ridge recess and recessed from the first body surface toward the second body surface. The first connector further includes a second connecting piece coupled or formed with the first connecting piece. The second connecting piece includes a first segment disposed at the first ridge recess and a second segment disposed at the first body recess.

In an exemplary embodiment, the first segment of the second connecting piece is aligned substantially with the interior surface of the ridge adjacent to the first ridge recess, and the second segment of the second connecting piece is aligned substantially with the first body surface of the main body adjacent to the first body recess.

In some exemplary embodiments, the ridge includes an exterior ridge surface, an interior ridge surface spaced apart from the exterior ridge surface, a top ridge surface connecting the exterior and interior ridge surfaces, and a height measured from the top ridge surface to the first body surface. Each of the first and second notches includes a notch depth, measured from the top ridge surface to a bottom surface of the first or second notch, that is smaller than the height of the ridge. A first ridge recess is formed adjacent to the first notch and the first body surface of the main body, and recessed from the interior ridge surface toward the exterior ridge surface. A first body recess is formed adjacent to the first ridge recess and recessed from the first body surface toward the second body surface. A second ridge recess is formed adjacent to the second notch and the first body surface of the main body, and recessed from the interior ridge surface toward the exterior ridge surface. A second body recess is formed adjacent to the second ridge recess and recessed from the first body surface toward the second body surface. Each of the first and second connectors further includes a second connecting piece coupled to or formed with the first connecting piece. The second connecting piece includes a first segment disposed at the first or second ridge recess and a second segment disposed at the first or second body recess.

In an exemplary embodiment, the second connecting piece of the first connector further includes a third segment. Cross-sectional-wise, the first, second and third segments of the second connecting piece collectively form a substantial U-shape or a substantial arc shape to receive a mounting bar.

In some exemplary embodiments, a block is formed at a bottom of the first notch and includes an interior block surface and a top block surface. The first connecting piece of the first connector includes a side wall abutting the interior block surface and fixedly coupled with the block.

In an exemplary embodiment, the top block surface is dented toward the bottom of the first notch to accommodate the handle connecting piece of the first connector.

In some exemplary embodiments, the ridge is formed with a notch. The first connector is disposed at a first side of the notch and the second connector is disposed at a second side of the notch.

In some exemplary embodiments, a first lug is formed at a first side of the notch, and a second lug is formed at a second side of the notch. The first connecting piece of the first connector is formed with a first slot to receive the first lug, and fixedly coupled with the first lug. The first connecting piece of the second connector is formed with a second slot to receive the second lug, and fixedly coupled with the second lug. A connector bridge is disposed between the first and second connectors, and coupled or formed with the first connecting pieces of the first and second connectors.

In some exemplary embodiments, the handle connecting piece of the first connector is disposed between the first slot of the first connector and the connector bridge, and the handle connecting piece of the second connector is disposed between the second slot of the second connector and the connector bridge.

In some exemplary embodiments, a first ridge recess is formed adjacent to the first lug and the first body surface of the main body, and recessed from the interior ridge surface toward the exterior ridge surface. A second ridge recess is formed adjacent to the second lug and the first body surface of the main body, and recessed from recessed from the interior ridge surface toward the exterior ridge surface. A first body recess is formed adjacent to the first ridge recess and is recessed from the first body surface toward the second body surface. A second body recess is formed adjacent to the second ridge recess and is recessed from the first body surface toward the second body surface. Each of the first and second connectors further includes a second connecting piece coupled or formed with the first connecting piece. The second connecting piece includes a first segment disposed at the first or second ridge recess, and a second segment disposed at the first or second body recess and fixedly coupled with the main body.

In some exemplary embodiments, a block is formed at a bottom of the first notch. The block includes an interior block surface and a top block surface. The first connecting piece of the first connector is fixedly coupled with the block. The first connecting piece of the first connector includes a first segment disposed on the top block surface and a second segment disposed beside the interior block surface of the block.

In some exemplary embodiments, at least a portion of the first attachment portion of the handling is disposed between the first segment of the first connecting piece of the first connector and the top block surface of the block formed at the bottom of the first notch.

In an exemplary embodiment, the first segment of the first connecting piece of the first connector is aligned substantially with a top ridge surface of the ridge adjacent to the first notch.

In some exemplary embodiments, the first connector further includes a second connecting piece coupled or formed with the first connecting piece. The second connecting piece is fixedly coupled with the main body.

In an exemplary embodiment, the second connecting piece of the first connector includes a first segment and a second segment. The first segment of the second connecting piece is formed or coupled with the first connecting piece of the first connector, and disposed on the first body surface of the main body. The second segment of the second connecting piece is extended from the first segment of the second connecting piece. At least a portion of the second segment of the second connecting piece is disposed at a receptacle formed at the main body.

In various exemplary embodiments, the present disclosure provides a portable structure including a main body, a ridge, a supporting assembly, first and second connectors, and a handle. The main body has a first body surface and a second body surface. The ridge is coupled or formed with the main body and extended in a first direction beyond the first body surface. The supporting assembly includes a mounting bar disposed adjacent to the ridge. Each of the first and second connectors includes a first connecting piece connected to the ridge and a second connecting piece coupled or formed with the first connecting piece. The second connecting piece includes a first segment disposed between the ridge and the mounting bar and a second segment disposed between the main body and the mounting bar, thereby cross-sectional-wise enclosing at least a portion of the mounting bar. The handle includes a first attachment portion connected to the first connector, a second attachment portion connected to the second connector, and a gripping portion between the first and second attachment portions to facilitate grasping of the handle by the user.

In some exemplary embodiments, the second connecting piece of either or both of the first and second connectors further includes a third segment. Cross-sectional-wise, the first, second and third segments of the second connecting piece collectively form a substantial U-shape or a substantial arc shape to receive the mounting bar.

In an exemplary embodiment, the ridge includes an exterior ridge surface, an interior ridge surface spaced apart from the exterior ridge surface, a top ridge surface connecting the exterior and interior ridge surfaces. The first connecting piece of each of the first and second connectors has a surface aligned with the top ridge surface. The first segment of the second connecting piece of each of the first and second connectors is aligned with the interior ridge surface. The second segment of the second connecting piece of each of the first and second connectors is aligned with the first body surface.

In various exemplary embodiments, the present disclosure provides a portable structure including a main body, a ridge, first and second connectors, and a handle. The main body has a first body surface and a second body surface. The ridge is coupled or formed with the main body and extended in a first direction beyond the first body surface. Each of the first and second connectors includes a first connecting piece connected to the ridge and a second connecting piece coupled or formed with the first connecting piece. The second connecting piece includes a first segment abutting the ridge, and a second segment abutting the main body and fixedly coupled with the main body. The handle includes a first attachment portion connected to the first connector, a second attachment portion connected to the second connector, and a gripping portion between the first and second attachment portions to facilitate grasping of the handle by the user.

In some exemplary embodiments, the ridge is formed with first and second ridge recesses, each recessed from the interior ridge surface toward the exterior ridge surface to accommodate the first segment of the second connecting piece of the first or second connector such that the first segment of the second connecting piece is aligned with the interior surface of the ridge. The main body is formed with first and second body recesses, each recessed from the first body surface toward the second body surface to accommodate the second segment of the second connecting piece of the first or second connector such that the second segment of the second connecting piece is aligned with the first body surface of the main body.

The portable structures of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1:
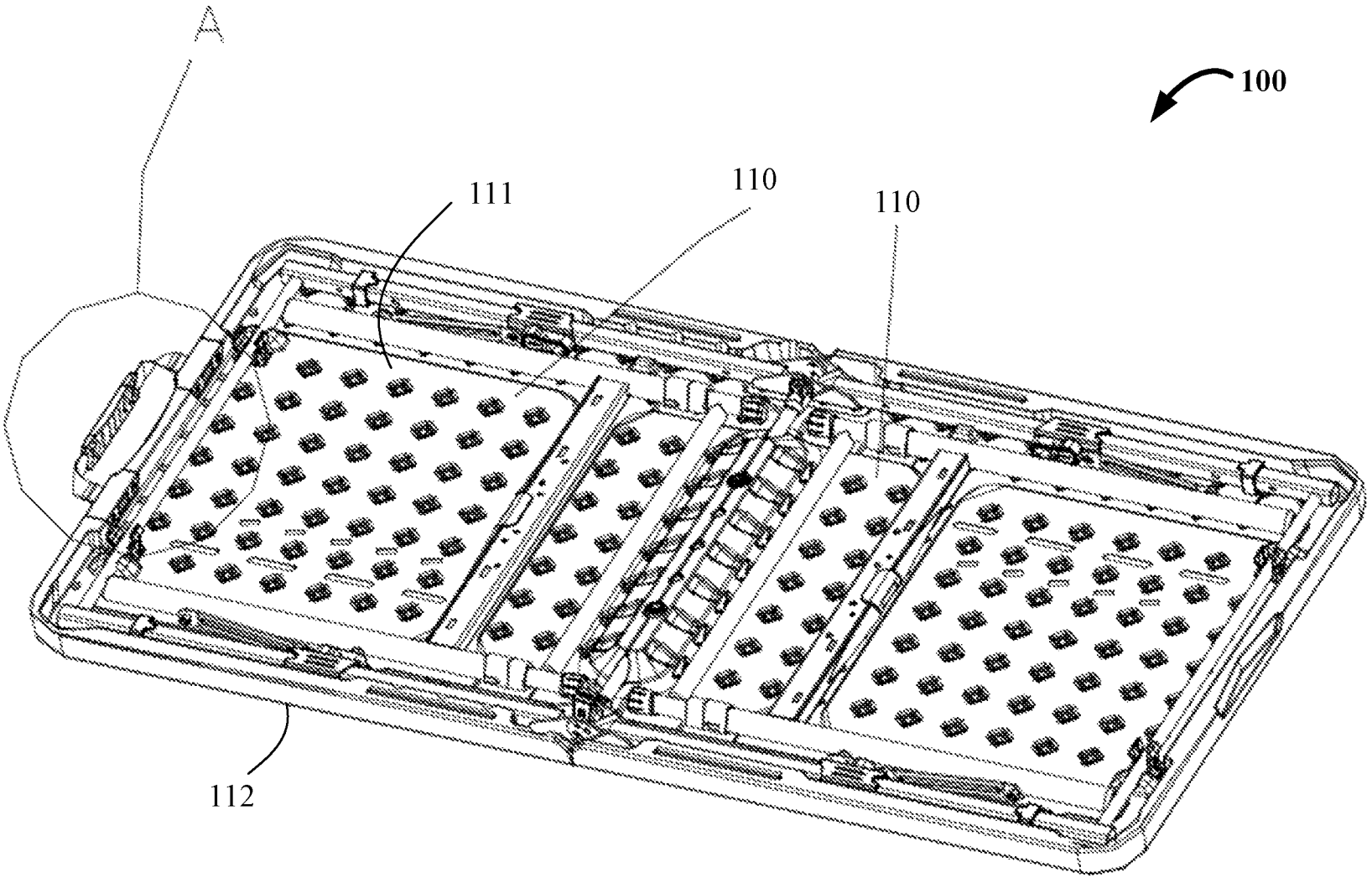
FIG. 1 is a bottom perspective view illustrating an exemplary portable structure (a foldable table, of which the tabletop is in an unfolded state) in accordance with some exemplary embodiments of the present disclosure.
Figure 2:
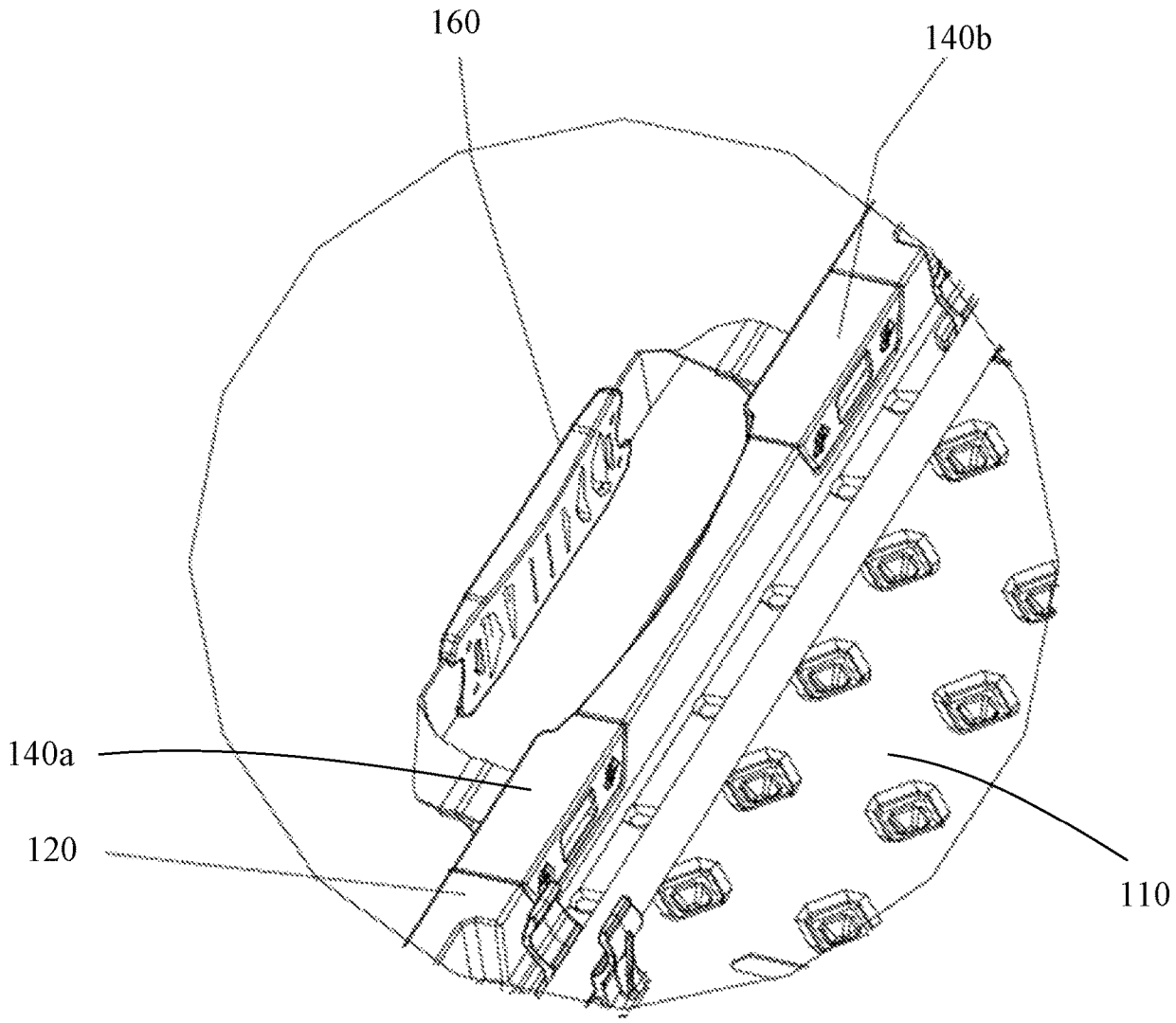
FIG. 2 is an enlarged view taken along circle A of FIG. 1.
Figure 3:
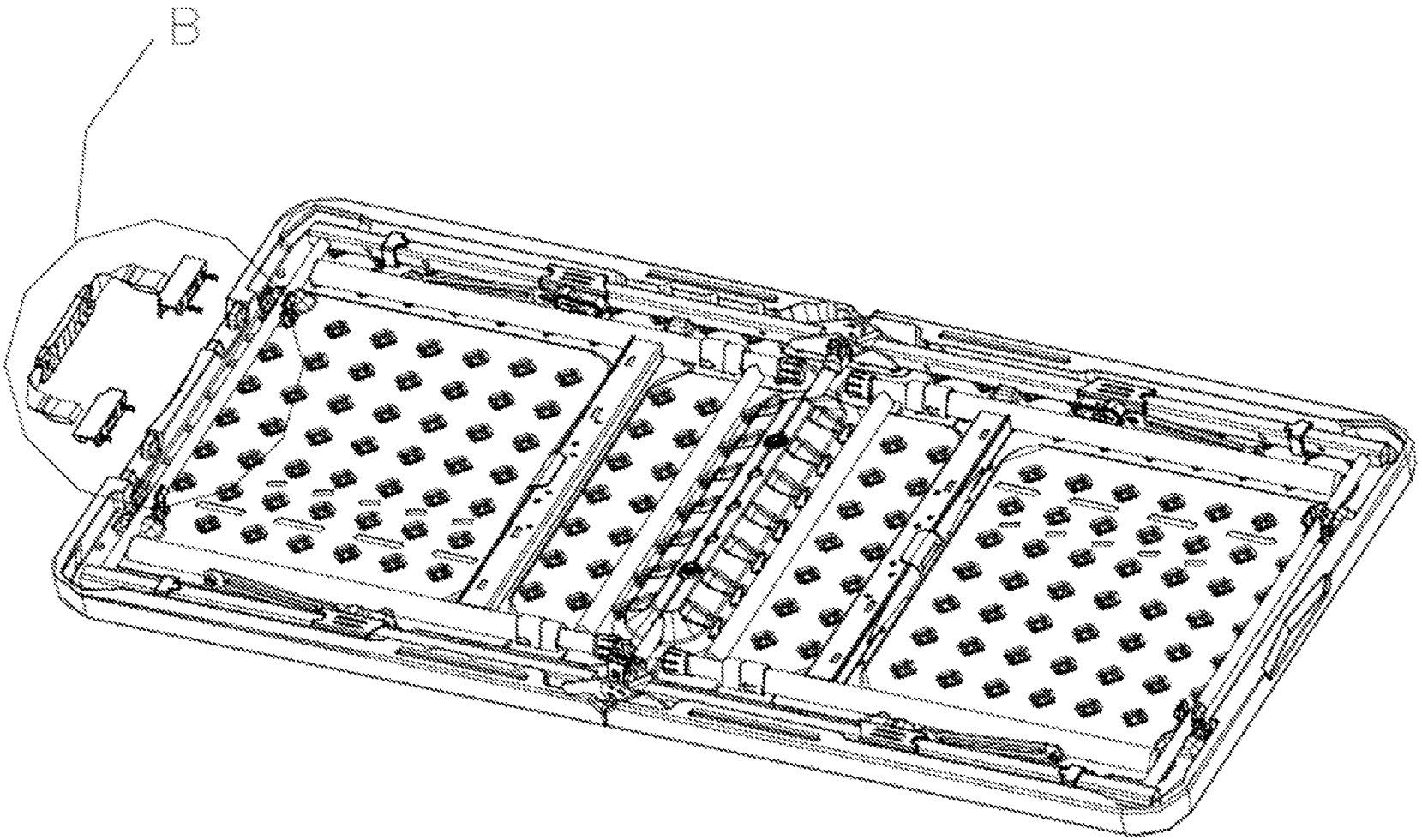
FIG. 3 is a partially disassembled view illustrating the exemplary portable structure of FIG. 1.
Figure 4:
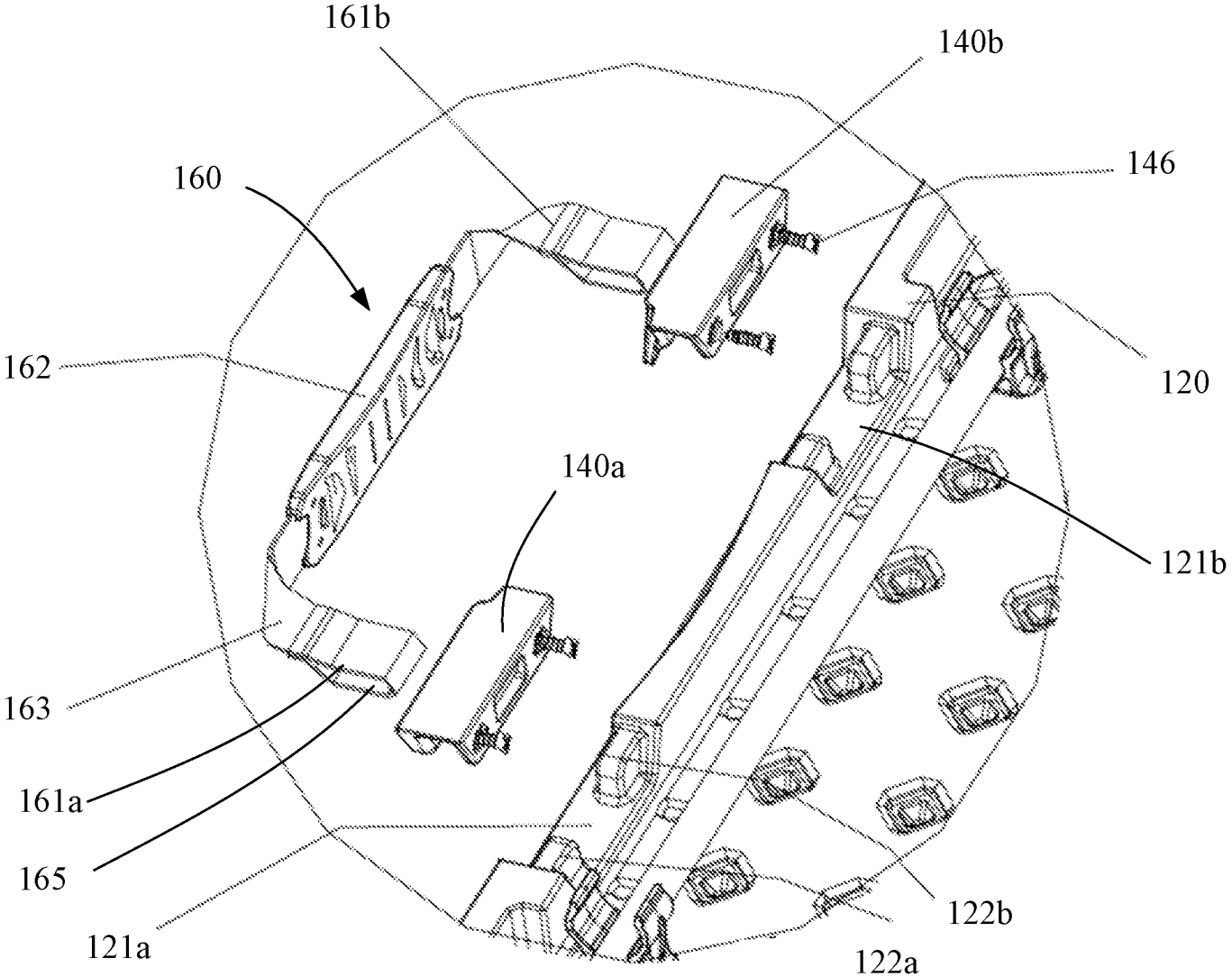
FIG. 4 is an enlarged view taken along circle B of FIG. 3.
Figure 5:
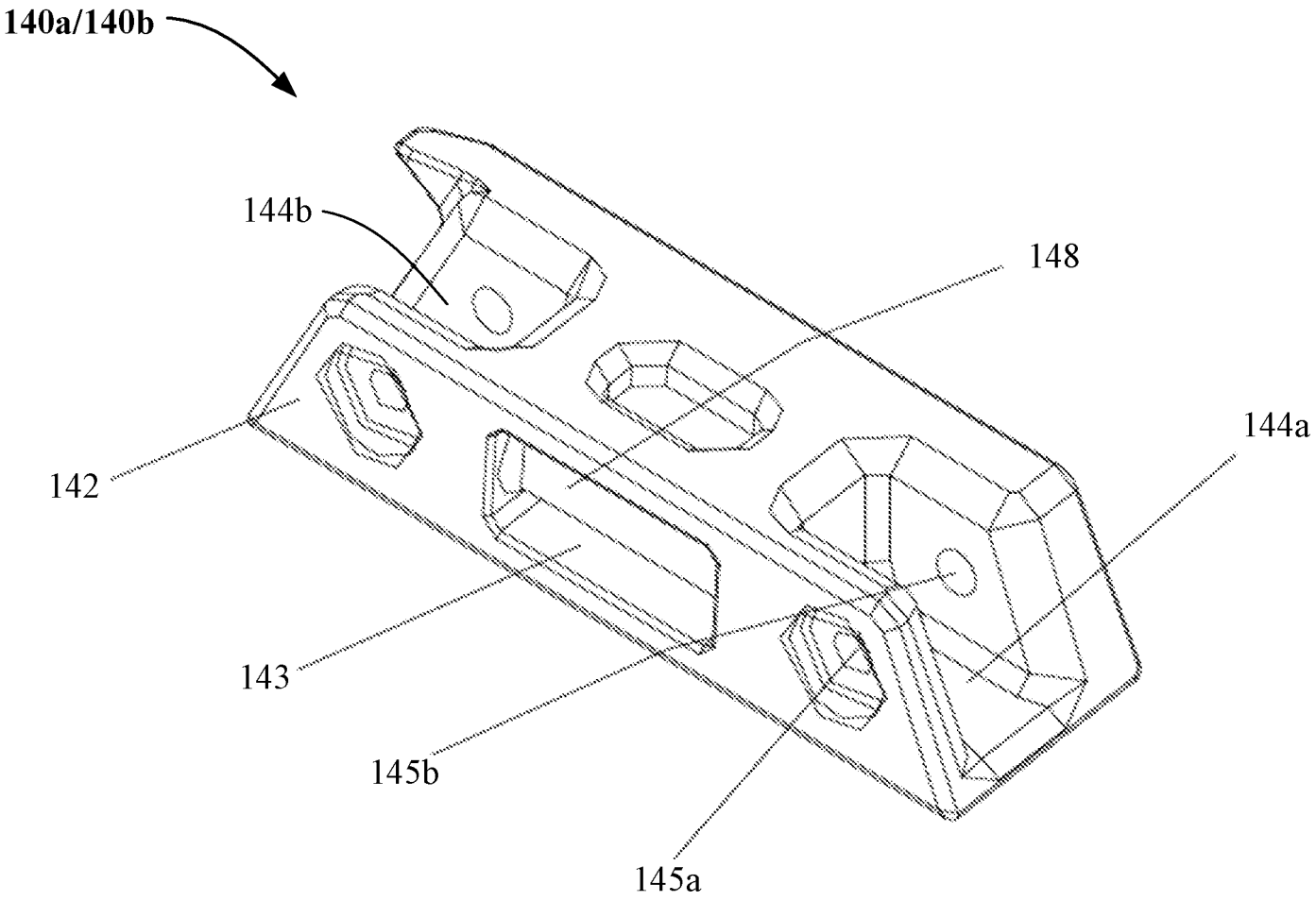
FIG. 5 is a perspective view illustrating an exemplary connector in accordance with some exemplary embodiments of the present disclosure.
Figure 6:
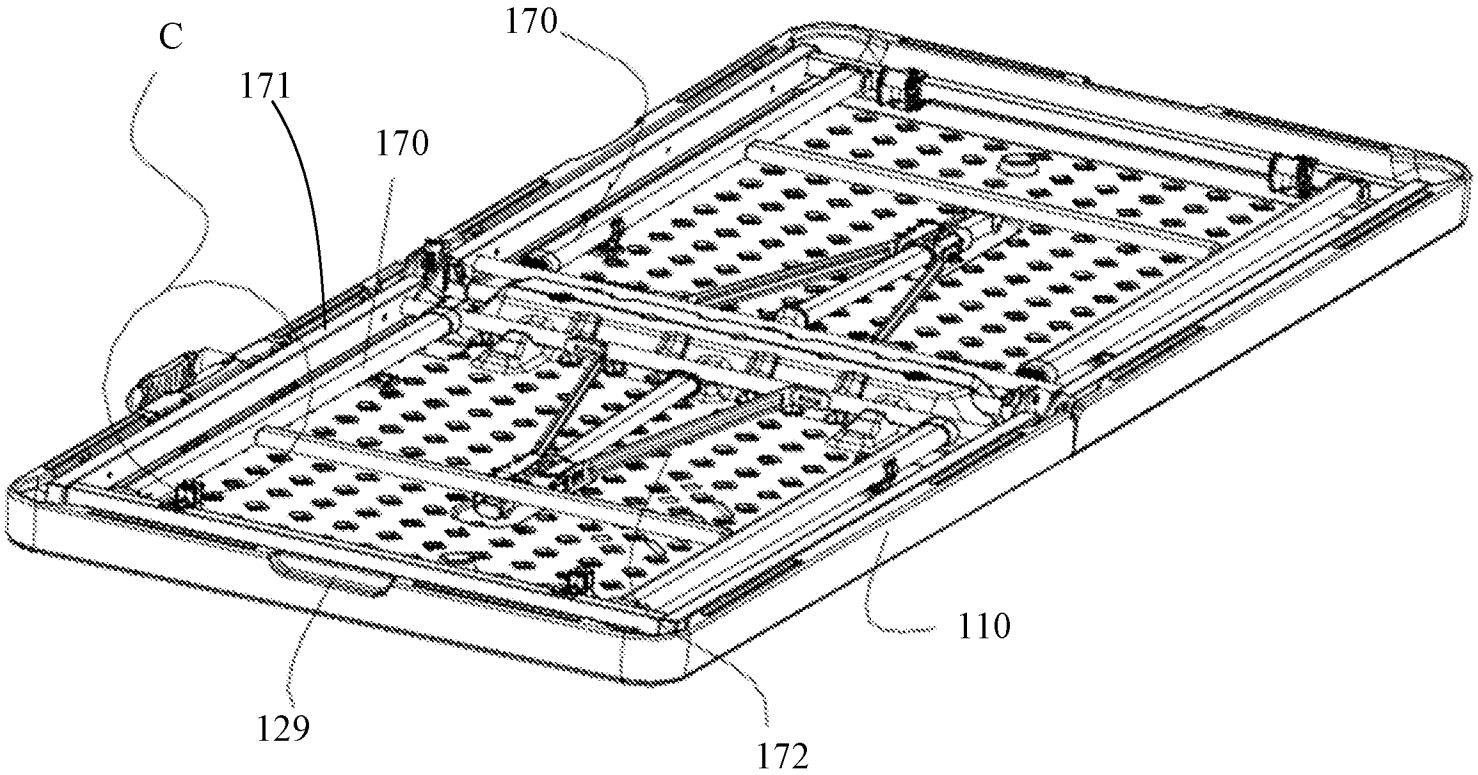
FIG. 6 is a bottom perspective view illustrating an exemplary portable structure (a foldable table, of which the tabletop is in an unfolded state) in accordance with some exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of portable structures. Generally, a portable structure of the present disclosure includes a main body, a ridge coupled or formed with the main body, and a handle connected to the ridge and/or main body by one or more connectors to facilitate carrying and moving of the structure. In some exemplary embodiments, a portable structure of the present disclosure also includes a supporting frame, and the handle is connected to the ridge, main body and/or supporting frame by one or more connectors.

A portable structure of the present disclosure can be any suitable furniture, compliance, system or the like, including but not limited to tables, chairs and beds. While the present disclosure shows portable structures in the form of a foldable table, it should be noted that this is a non-limiting example and that the connections disclosed herein between the handle and relevant components can be applied readily in other portable structures.

Referring now to FIGS. 1-5, there is depicted exemplary portable structure 100 (a foldable table) in accordance with some exemplary embodiments of the present disclosure. As shown, portable structure 100 includes a main body such as main body 110 (e.g., the table panel at the left side of FIG. 1). Main body 110 has a first body surface such as surface 111 (e.g., the lower surface of the table panel) and a second body surface such as surface 112 (e.g., the upper surface of the table panel). The first or second body surface can be planar or curved or composed of planar and curved sections. Also, the first or second body surface can include other features such as depressions, protrusions or the like. In an exemplary embodiment, the main body is made by blow molding of a plastic and has a generally hollow interior between the first and second body surfaces.

Portable structure 100 also includes a ridge, such as ridge 120, coupled or formed with the main body. The ridge is generally extended in a first direction (e.g., the height direction of the table when in use) beyond first body surface 111. The ridge can be disposed at any suitable position relative to the main body. For instance, the ridge can be disposed at or adjacent to an edge of the main body, at or adjacent to a perimeter of the main body, or at a position away from an edge or the perimeter of the main body. The ridge can also be straight or curved or composed of straight and curved sections. Further, the ridge can be coupled with the main body, or monolithically formed with the main body as a unitary one-piece, for instance, by blow molding or the like.

Portable structure 100 further includes a handle such as handle 160 connected to the main body and the ridge by one or more connectors such as first connector 140*a* and second connector 140*b*. The first and second connectors can be but do not necessarily have to be identical or symmetric with respect to each other. By way of example, FIGS. 1-4 illustrate first connector 140*a* and second connector 140*b* that are substantially the same and disposed symmetrically with respect to each other. Also, the first and second connectors can be separated from each other or coupled to/formed with each other as a one-piece component. By way of example, FIGS. 1-4 illustrate two individual connectors that are separated from each other.

In some exemplary embodiments, each of first connector 140*a* and second connector 140*b* is coupled with the ridge. For instance, in some exemplary embodiments, ridge 120 is formed with a first notch such as first notch 121*a* and a second notch such as second notch 121*b*. The first and second notches can be but do not necessarily have to be identical or symmetric with respect to each other. By way of example, FIGS. 1-4 illustrate first notch 121*a* and second notch 121*b* that are substantially the same and disposed symmetrically with respect to each other.

At one or each of the first and second notches, a first lug such as first lug 122*a* is formed at a first side of the notch, and a second lug such as second lug 122*b* is formed at a second side of the notch. The first and second lugs can be, but do not necessarily have to be, identical or symmetric with respect to each other. By way of example, FIGS. 1-4 illustrate first and second lugs that are substantially the same and disposed symmetrically with respect to each other.

First connector 140*a* is disposed at first notch 121*a* and second connector 140*b* is disposed at second notch 121*b*. The first or second connector includes a first connecting piece such as first connecting piece 142. First connecting piece 142 is formed with a first slot such as first slot 144*a* to receive the first lug and a second slot such as second slot 144*b* to receive the second lug. In an exemplary embodiment, the first connecting piece is fixedly coupled with the first and second lugs, for instance, by fastener 146 through hole 145*a* and hole 145*b* formed at the side walls of the first or second slots. Hole 145*b* is usually not a through-hole to prevent the fastener from protruding out, affecting adversely the appearance of the structure or risking injury to people.

Each of first connector 140*a* and second connector 140*b* also includes a handle connecting piece such as handle connecting piece 148. Handle connecting piece 148 is coupled or formed with first connecting piece 142. In some exemplary embodiments, each of the first and second connectors includes at least one opening, such as opening 143, formed at the first connecting piece, so that the handle connecting piece is accessible from the outside through the at least one opening formed at the first connecting piece.

In some exemplary embodiments, the handle connecting piece is disposed between the first and second slots formed at the first connecting piece; and the first and second lugs are spaced apart from each other, thereby creating a space in between to accommodate the handle connecting piece of the first or second connector.

Handle 160 is connected to the first and second connectors. For instance, in some exemplary embodiments, the handle includes a first attachment portion such as first attachment 161*a*, a second attachment portion such as second attachment portion 161*b*, and a gripping portion such as gripping portion 162. The first and second attachment portions can be, but do not necessarily have to be identical. By way of example, FIGS. 1-5 illustrate the first and second attachment portions that are substantially the same. The first attachment portion passes through opening 143 formed at the first connecting piece of the first connector and, cross-sectional-wise, surrounds the handle connecting piece of the first connector. Similarly, the second attachment portion passes through opening 143 formed at the first connecting piece of the second connector and, cross-sectional-wise, surrounds the handle connecting piece of the second connector. The gripping portion is disposed between the first and second attachment portions to facilitate grasping of the handle.

In some exemplary embodiments, the handle includes a strap such as strap 163, optionally made of a flexible material (e.g., fabric or the like). The first attachment portion of the handle is formed from a first end portion of the strap, for instance, by inserting the first end of the strap into opening 143, turning it around the handle connecting piece, pulling it out of opening 143, and then attaching it (e.g., stitching or the like) to a portion of the strap adjacent to the first end of the strap. Similarly, the second attachment portion of the handle is formed from a second end portion of the strap, for instance, by inserting the second end of the strap into opening 143, turning it around the handle connecting piece, pulling it out of opening 143, and then attaching it (e.g., stitching or the like) to a portion of the strap adjacent to the second end of the strap. In an exemplary embodiment, a loop, such as loop 165, is formed at the first or second attachment portion of the handle.

In an exemplary embodiment, the gripping portion is sleeved onto a middle portion of the strap. The gripping portion can be made of any suitable materials, including but not limited to plastics, rubbers, fabrics, woods, or the like.

Referring to FIGS. 6-10, in some exemplary embodiments, one or each of first connector 140*a* and second connector 140*b* further includes a second connecting piece such as second connecting piece 149. Second connecting piece 149 is coupled or formed with first connecting piece 142. In some exemplary embodiments, the second connecting piece includes a first segment such as first segment 149*a* coupled or formed with the first connecting piece and a second segment such as second segment 149*b* bended with respect to the first segment. In an exemplary embodiment, the second segment is substantially perpendicular to the first segment.

The first segment of the second connecting piece abuts the ridge and the second segment of the second connecting piece abuts the main body, thereby reducing the local stresses at the first and second lugs and enhancing the strength of the connection. In some exemplary embodiments, the second segment of the second connecting piece is fixedly coupled with the main body, further reducing the local stresses and enhancing the strength of the connection.

In some exemplary embodiments, to accommodate second connecting piece 149, the ridge and/or main body are formed with one or more recesses. For instance, in some exemplary embodiments, ridge 120 includes an exterior ridge surface such as exterior ridge surface 123, an interior ridge surface such as interior ridge surface 124, and a top ridge surface such as top ridge surface 125. The interior ridge surface is generally spaced apart from the exterior ridge surface, and the top ridge surface connects (e.g., joins) the exterior and interior ridge surfaces. Ridge 120 has a height measured from top ridge surface 125 to first body surface 111. The first and second notches are not formed all the way through the entire height of the ridge. Instead, each of the first and second notches has a notch depth, measured from top ridge surface 125 to bottom surface 127 of the notch, that is smaller than the height of the ridge.

To accommodate first segment 149*a* of the second connecting piece of the first connector, a first ridge recess such as first ridge recess 126*a* is formed at the ridge adjacent to the first notch and the first body surface of the main body. The first ridge recess is recessed from the interior ridge surface toward the exterior ridge surface. To accommodate second segment 149*b* of the second connecting piece of the first connector, a first body recess such as first body recess 113*a* is formed adjacent to the first ridge recess and recessed from the first body surface toward the second body surface. In an exemplary embodiment, the first ridge recess and first body recess are connected to (e.g., joined with) each other.

Similarly, to accommodate first segment 149*a* of the second connecting piece of the second connector, a second ridge recess such as second ridge recess 126*b* is formed at the ridge adjacent to the second notch and the first body surface of the main body. The second ridge recess is recessed from the interior ridge surface toward the exterior ridge surface. To accommodate second segment 149*b* of the second connecting piece of the second connector, a second body recess such as second body recess 113*b* is formed adjacent to the second ridge recess and recessed from the first body surface toward the second body surface. In an exemplary embodiment, the second ridge recess and second body recess are connected to (joined with) each other.

In some exemplary embodiments, the first or second ridge recess is configured with a depth substantially the same as the thickness of the first segment of the second connecting piece, and the first or second body recess is configured with a depth substantially the same as the thickness of the second segment of the second connecting piece. As such, when the first segment is disposed at the first or second ridge recess and the second segment is disposed at the first or second body recess, the first segment of the second connecting piece is aligned substantially with the local interior surface of the ridge (e.g., the interior surface of the ridge adjacent to the first or second ridge recess) and the second segment of the second connecting piece is aligned substantially with the local first body surface of the main body (e.g., the first body surface of the main body adjacent to the first or second body recess).

Figure 7:
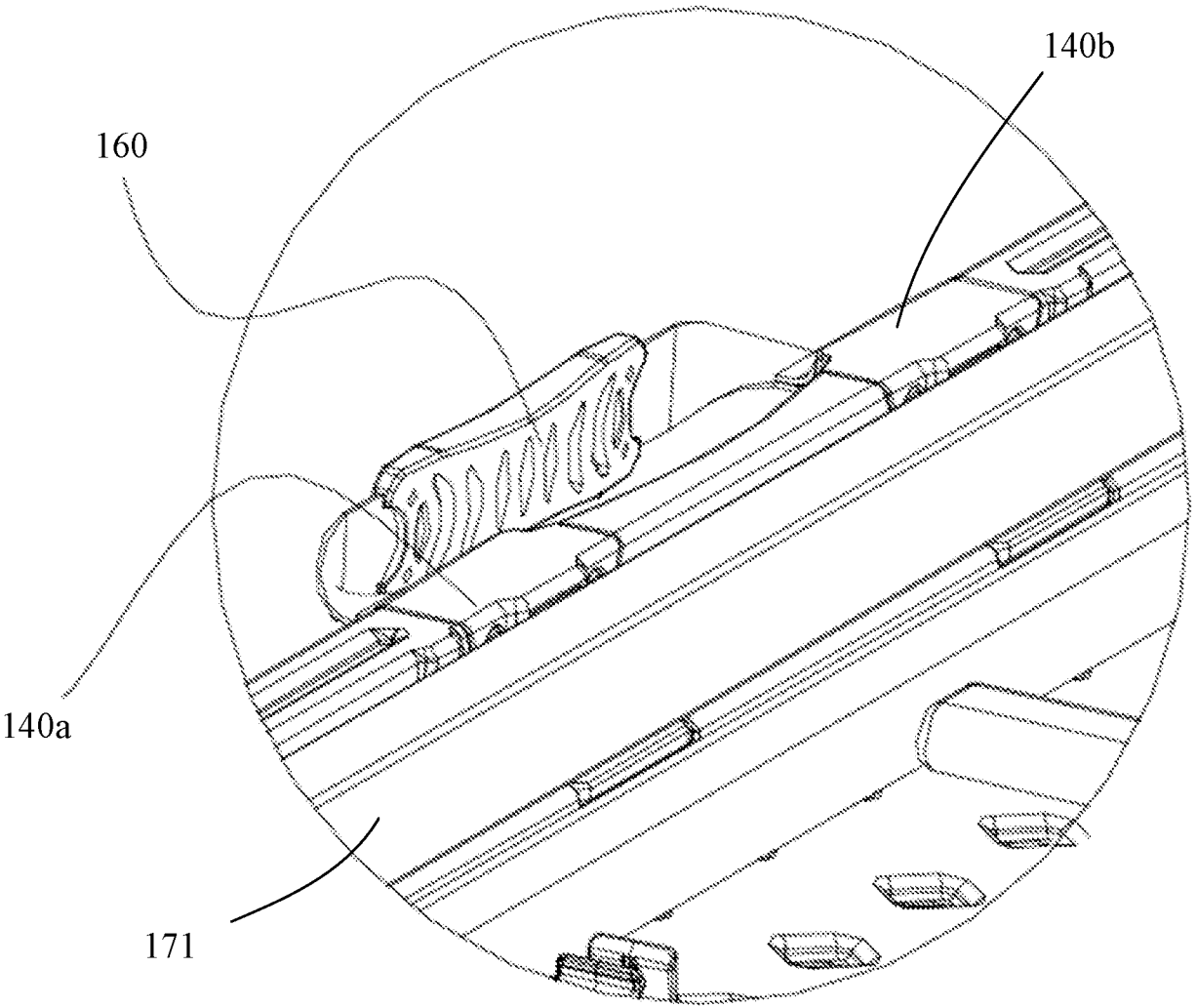
FIG. 7 is an enlarged view taken along circle C of FIG. 6.
Figure 8:
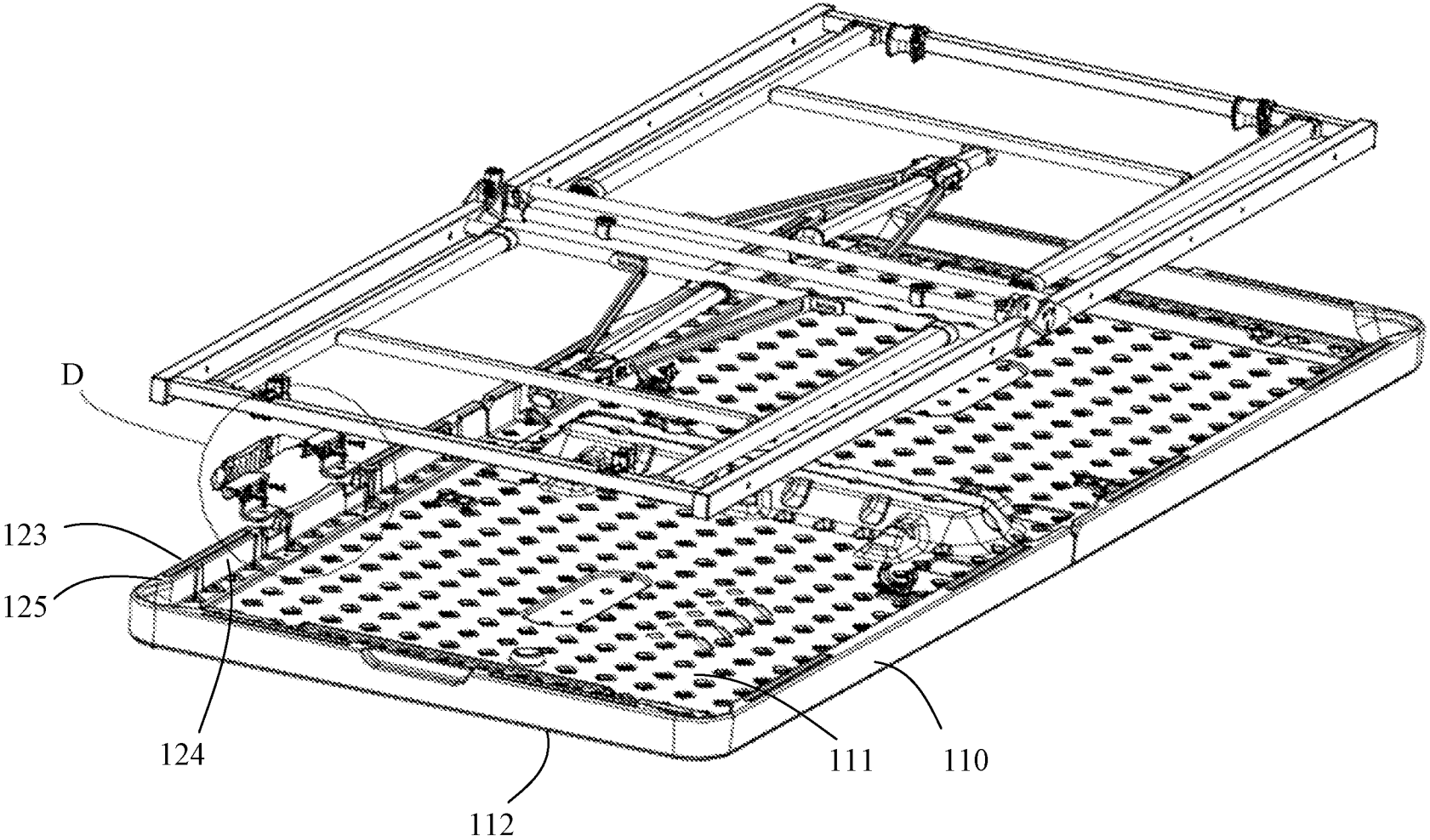
FIG. 8 is a partially disassembled view illustrating the exemplary portable structure of FIG. 6.
Figure 9:
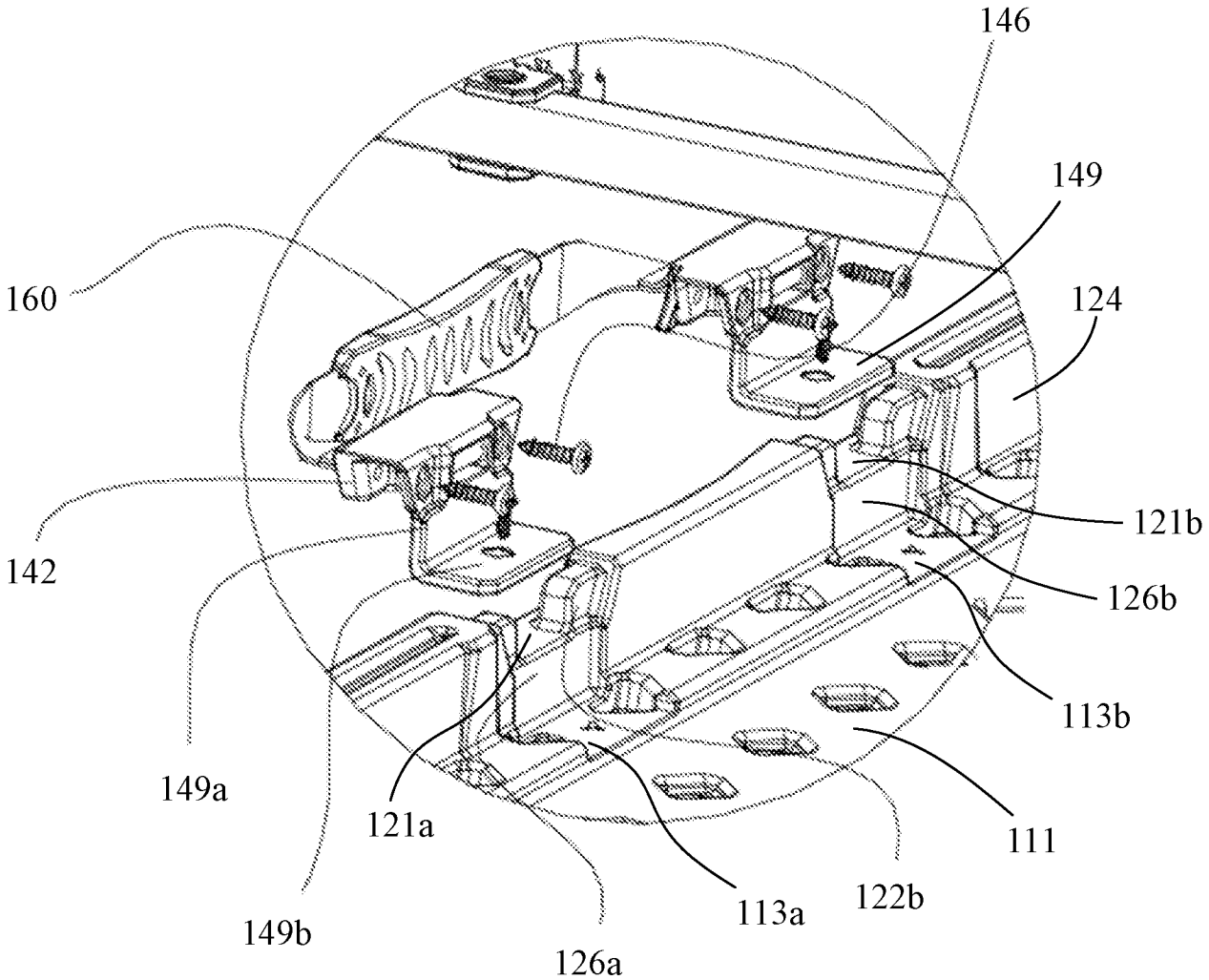
FIG. 9 is an enlarged view taken along circle D of FIG. 8.
Figure 10:
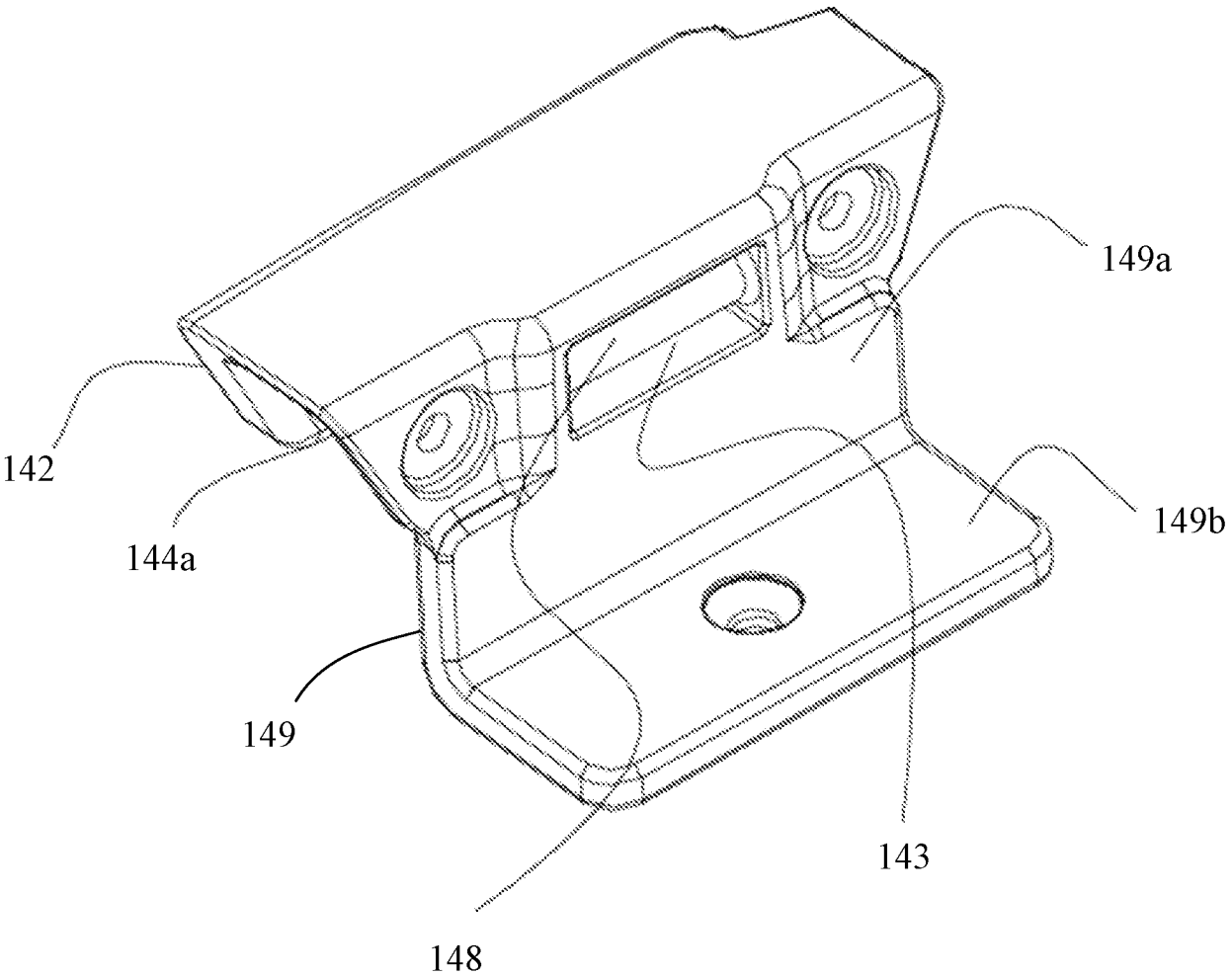
FIG. 10 is a perspective view illustrating an exemplary connector in accordance with some exemplary embodiments of the present disclosure.
Figure 11:
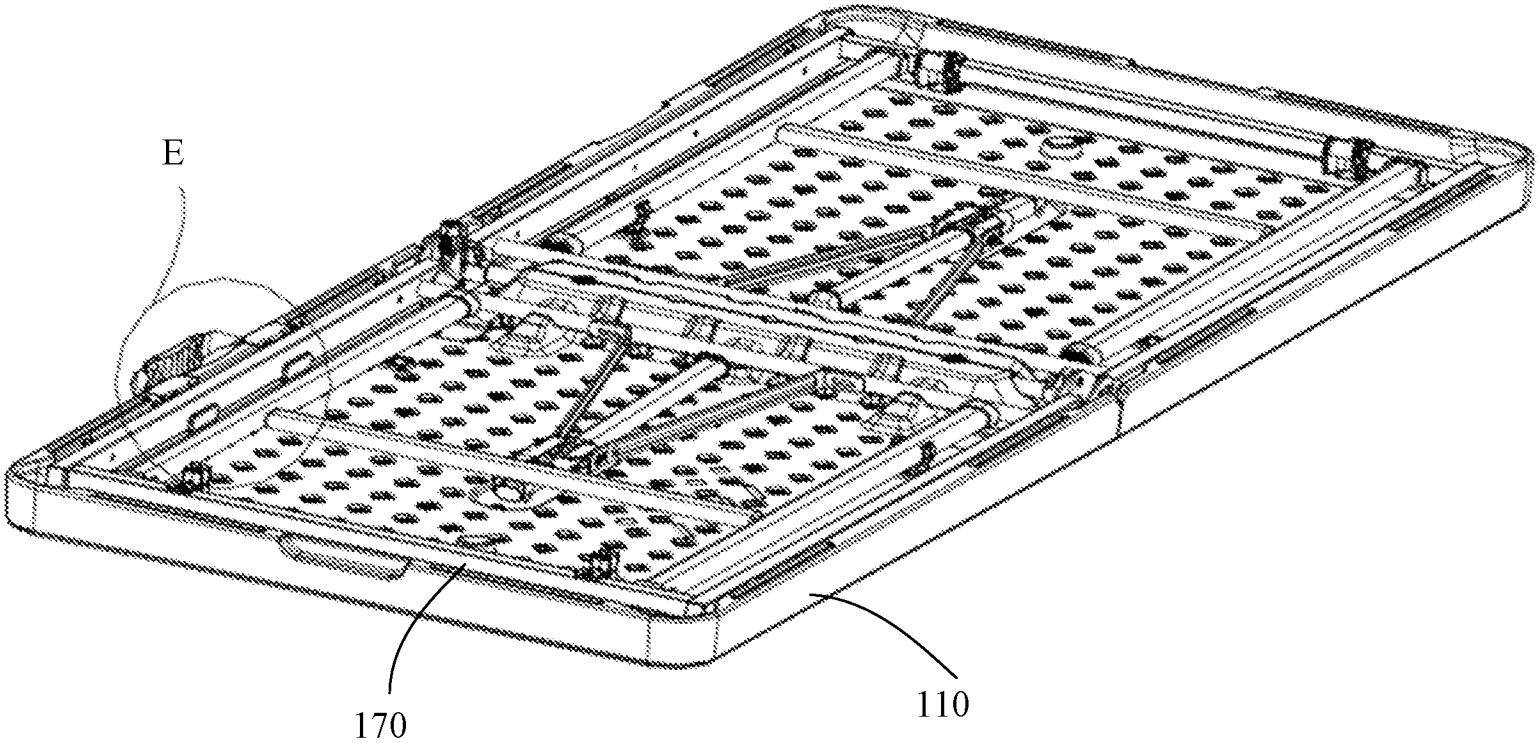
FIG. 11 is a bottom perspective view illustrating an exemplary portable structure (a foldable table, of which the tabletop is in an unfolded state) in accordance with some exemplary embodiments of the present disclosure.
Figure 12:
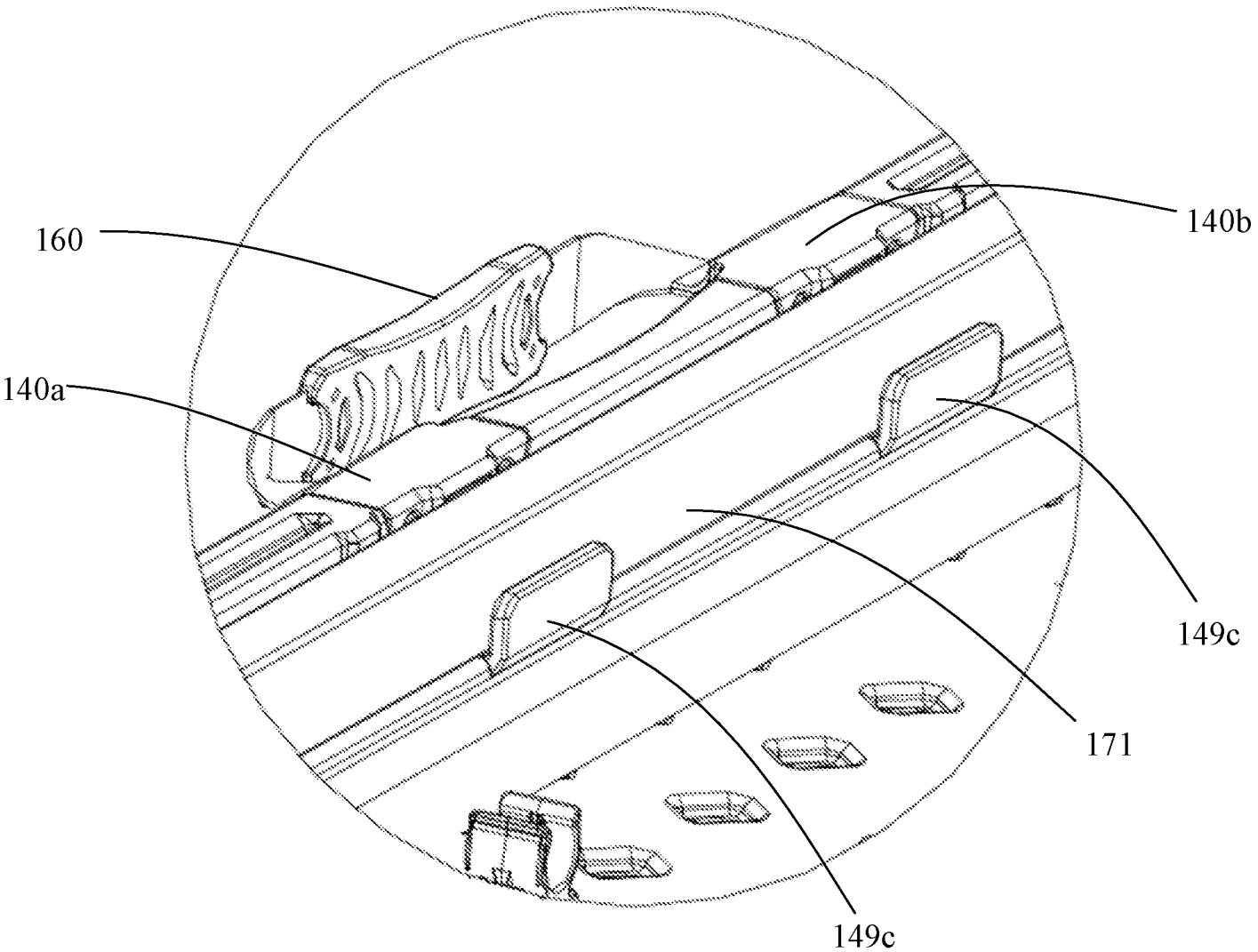
FIG. 12 is an enlarged view taken along circle E of FIG. 11.
Figure 13:
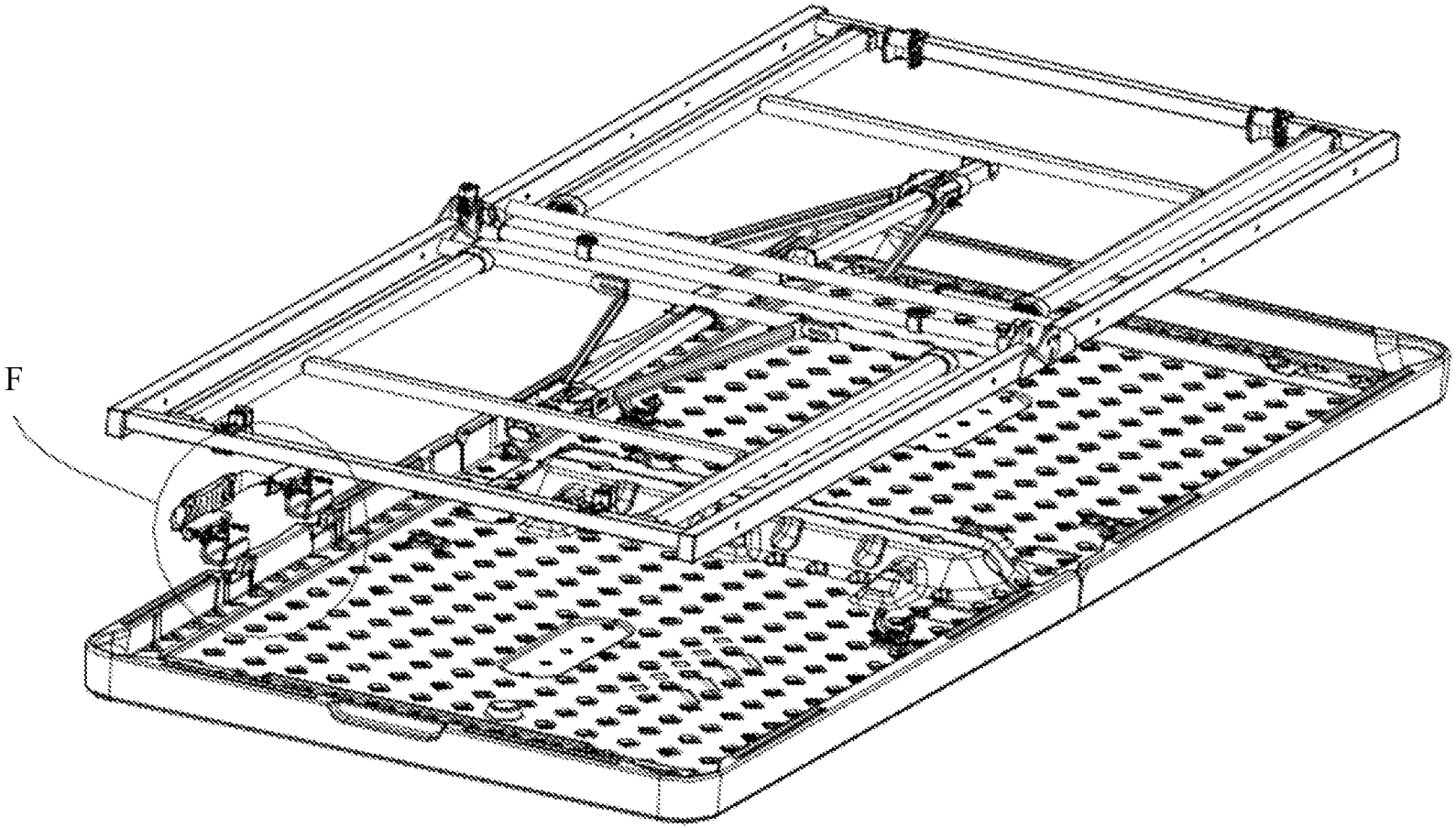
FIG. 13 is a partially disassembled view illustrating the exemplary portable structure of FIG. 11.
Figure 14:
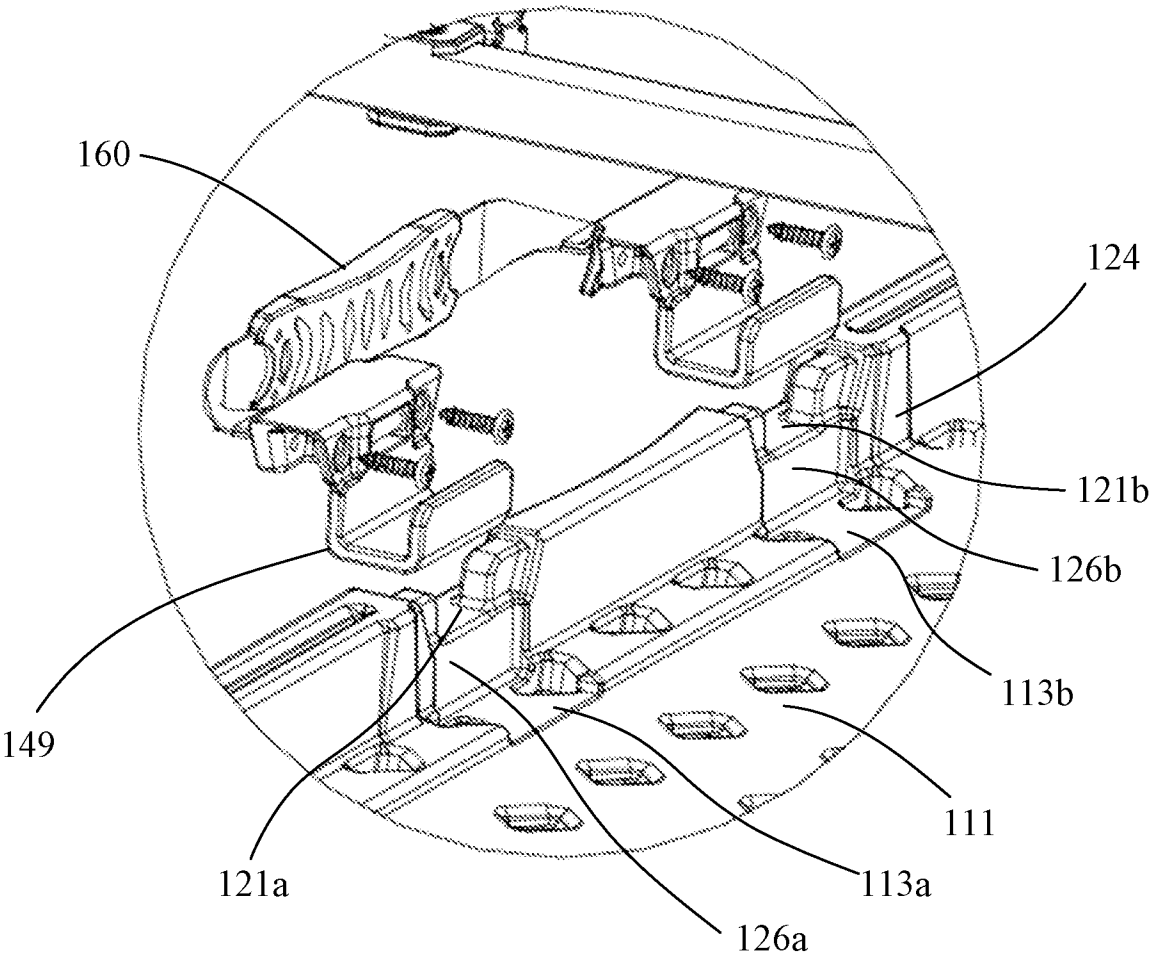
FIG. 14 is an enlarged view taken along circle F of FIG. 13.
Figure 15:
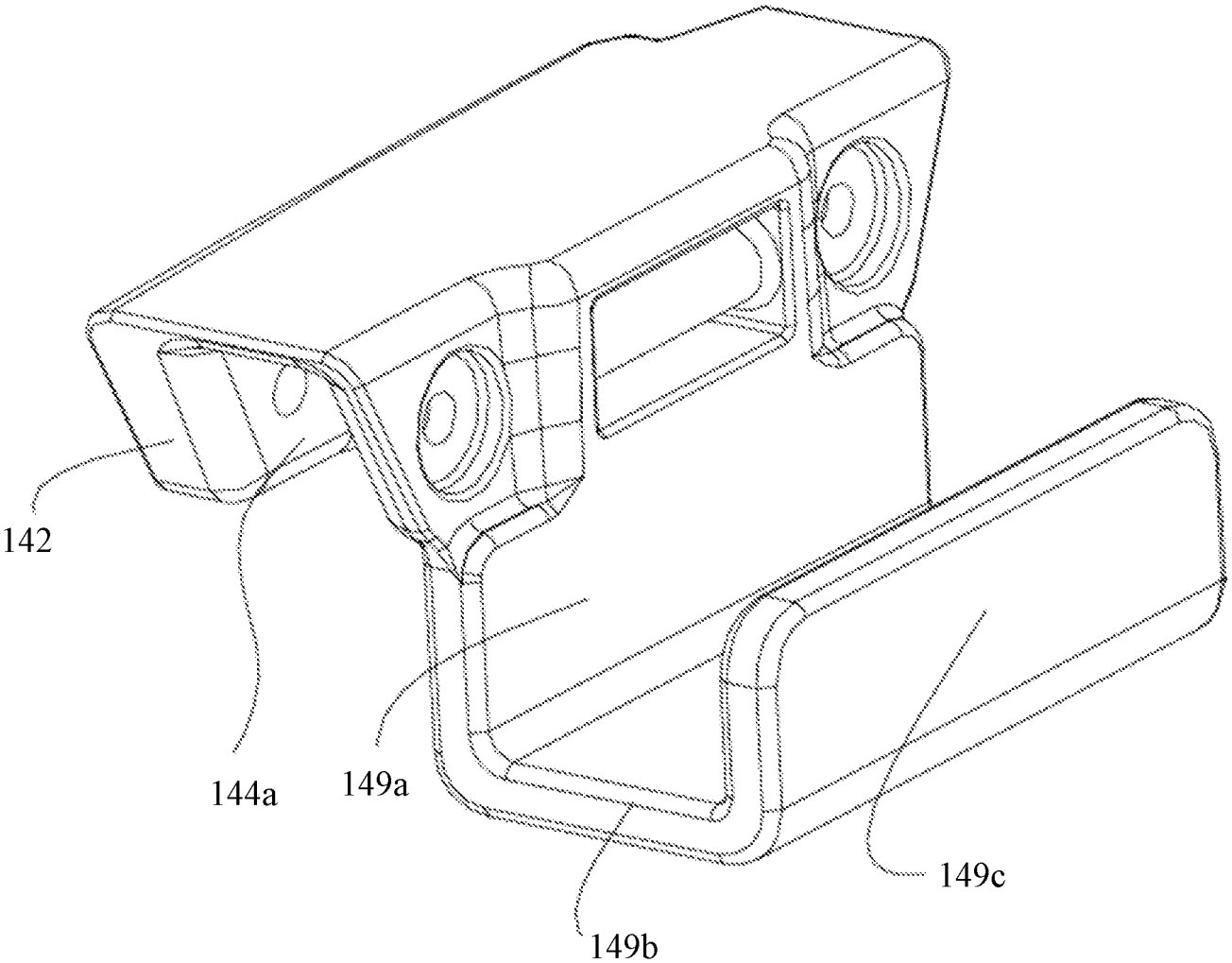
FIG. 15 is a perspective view illustrating an exemplary connector in accordance with some exemplary embodiments of the present disclosure.

In some exemplary embodiments, first connecting piece 142 of each of the first and second connectors has a surface aligned with the local top ridge surface as illustrated in FIG. 7.

In some exemplary embodiments, portable structure 100 further includes a supporting assembly such as supporting assembly 170. Supporting assembly 170 includes a mounting bar such as mounting bar 171 disposed adjacent to the ridge, with the first segment of the second connecting piece disposed between the ridge and the mounting bar and the second segment of the second connecting piece disposed between the main body and the mounting bar. As such, the second connecting piece abuts the mounting bar and, cross-sectional-wise, encloses at least a portion of the mounting bar. This further reduces the local stress at the first and second lugs and enhances the strength of the connection.

In some exemplary embodiments, supporting assembly 170 includes a leg assembly rotatable with respect to the main body and a mechanism such as mechanism 172 to control and/or support the leg assembly of the supporting assembly.

In some exemplary embodiments, the structure is foldable. For instance, the structure is a foldable table including first and second main bodies (table panels) 110, and first and second supporting assemblies 170. The first and second supporting assemblies are pivotally connected to each other at their proximal sides. The first main body is coupled with the first supporting assembly and the second main body is coupled with the second supporting assembly such that the first and second main bodies are rotatable with respect to each other between a folded position and an unfolded position. In an exemplary embodiment, a notch such as notch 129 is formed at the ridge of the first or second main body or at the ridge of each main body to facilitate unfolding of the foldable table.

Referring to FIGS. 11-15, in some exemplary embodiments, second connecting piece 149 of the first and/or second connector further includes a third segment such as third segment 149*c*. Cross-sectional-wise, the first, second and third segments of the second connecting piece collectively form a substantial U-shape or a substantial arc shape to receive the mounting bar.

In such embodiments, the second connecting piece of each connector abuts the mounting bar and, cross-sectional-wise, encloses at least a portion of the mounting bar. Because of its substantial U-shape or arc shape, the second connecting piece grasps the mounting bar when using the handle to carry the structure, and transfers at least a portion of the load to the mounting bar. In turn, the mounting bar distributes the load to the other parts of the supporting assembly and other portions of the main body. This significantly reduces the local stresses at the first and second lugs, enhances the strength of the connection and prolongs the service life of the structure.

Figure 16:
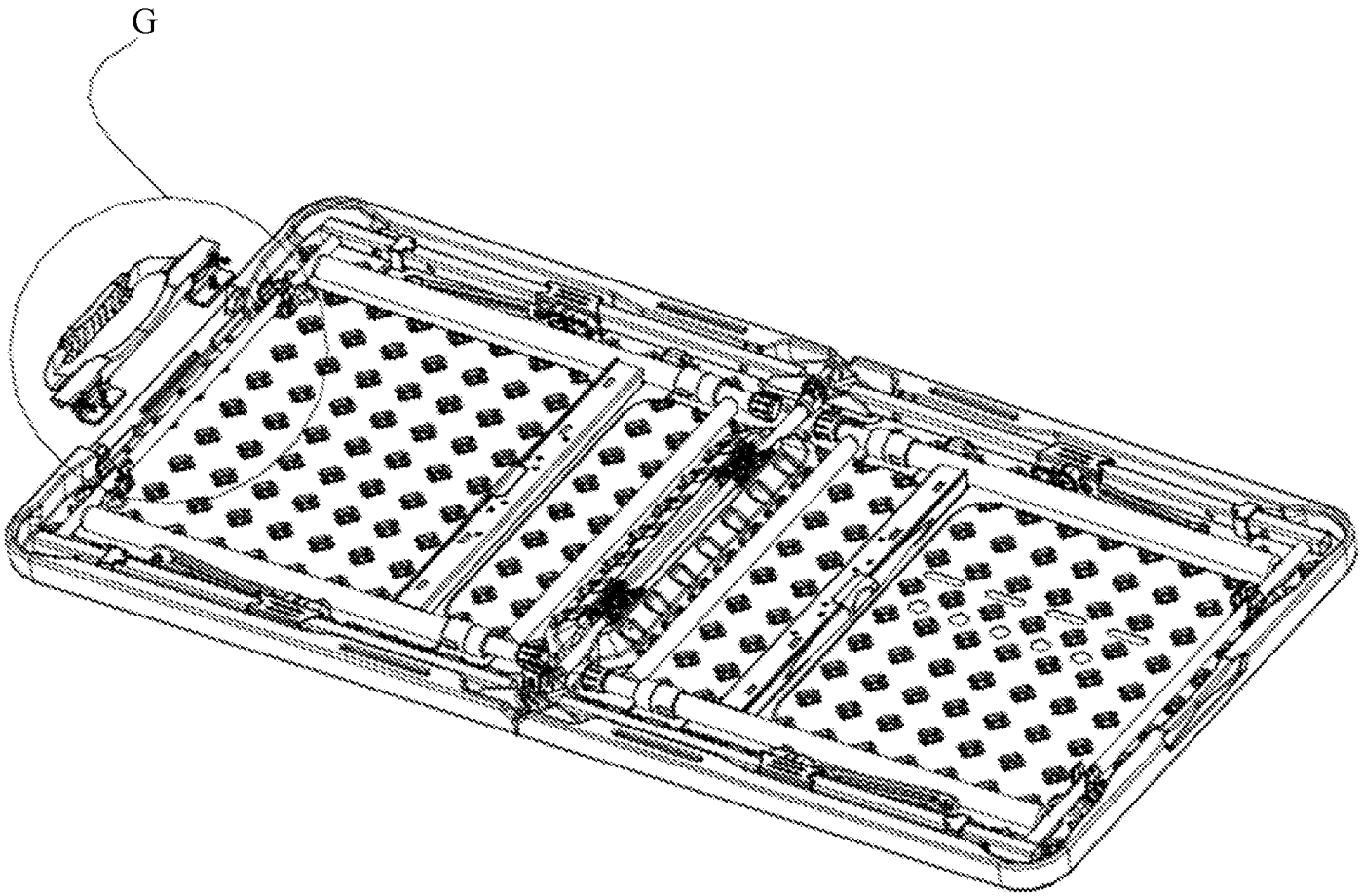
FIG. 16 is a partially disassembled, bottom perspective view illustrating an exemplary portable structure (a foldable table, of which the tabletop is in an unfolded state) in accordance with some exemplary embodiments of the present disclosure.
Figure 17:
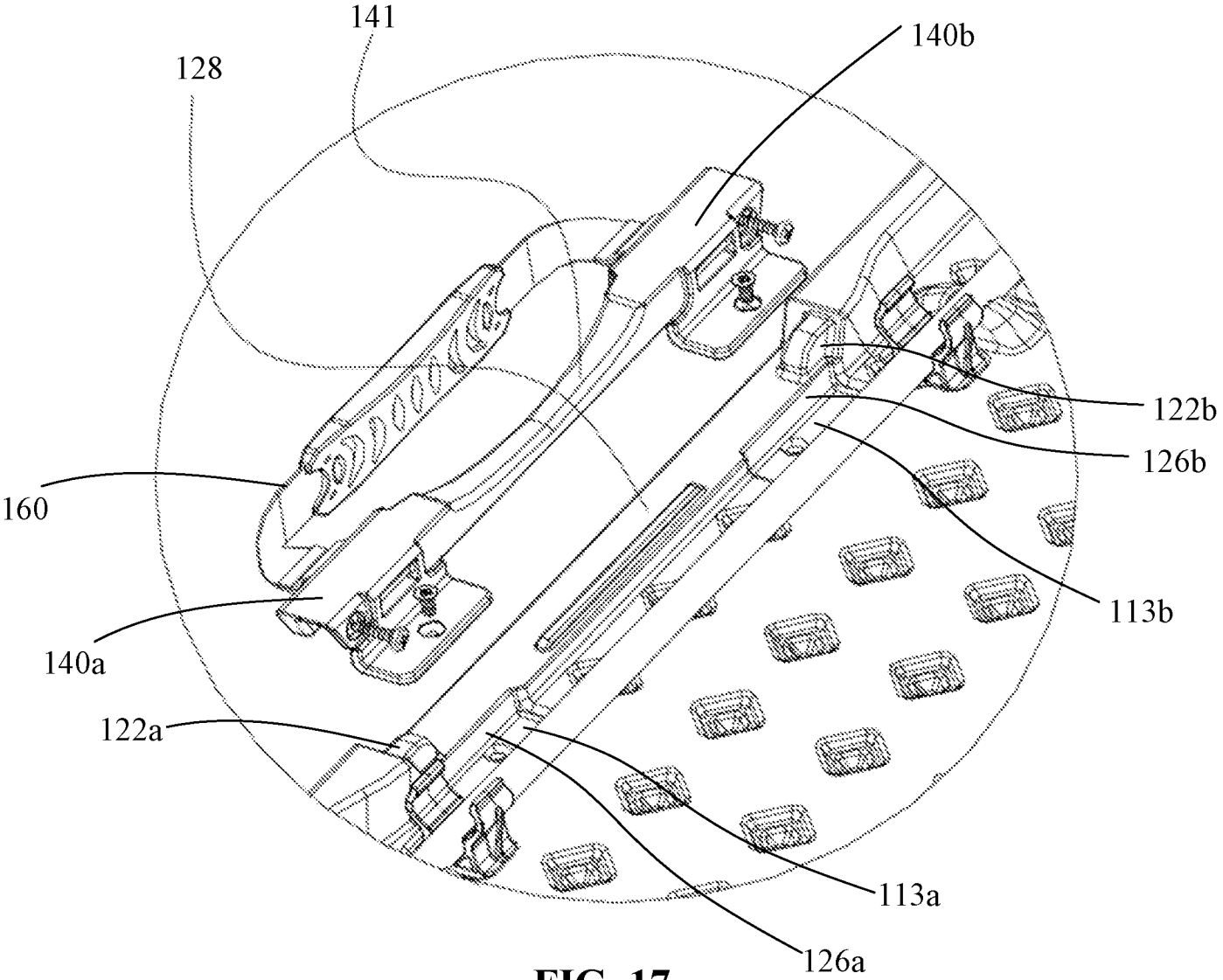
FIG. 17 is an enlarged view taken along circle G of FIG. 16.
Figure 18:
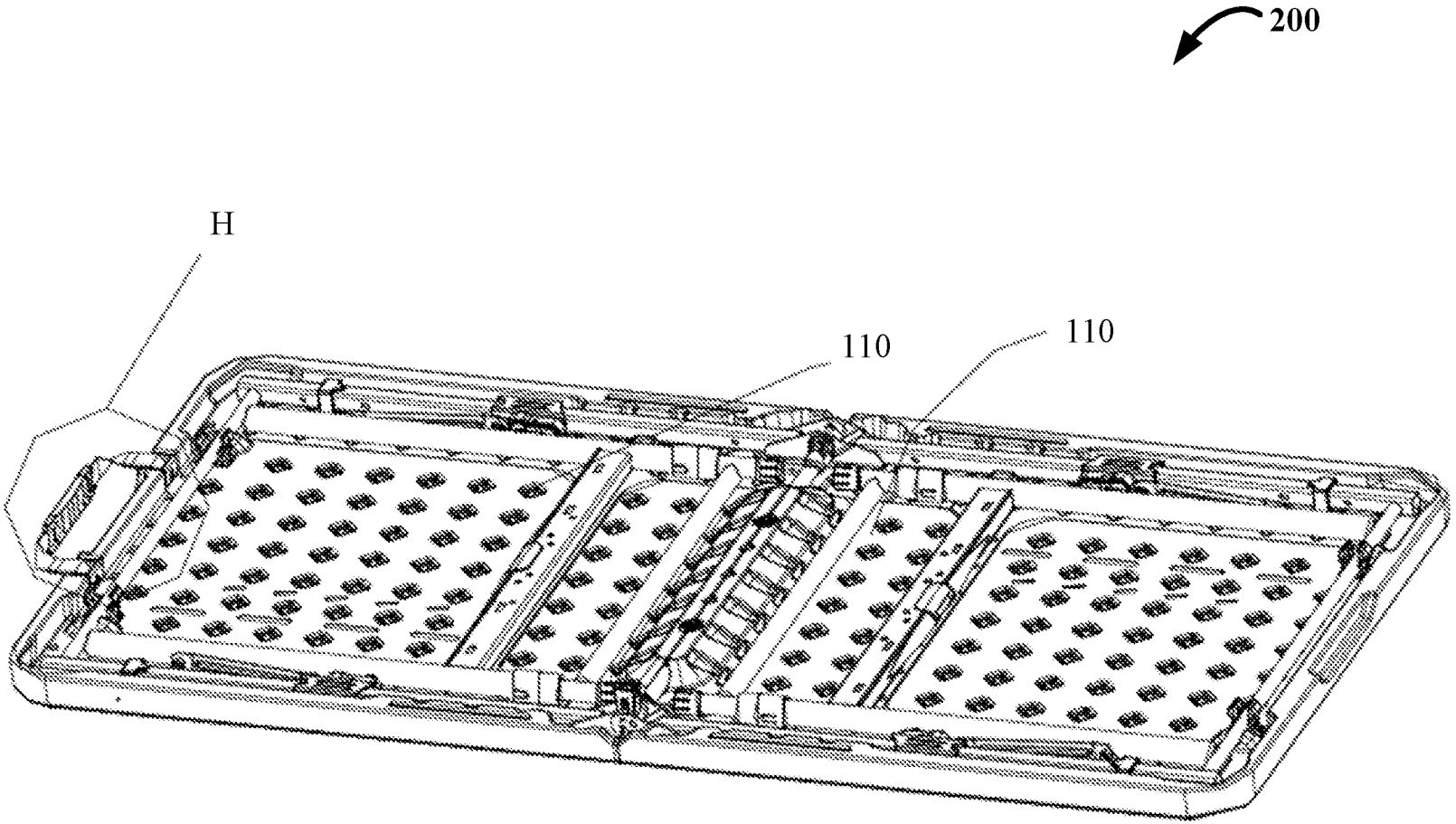
FIG. 18 is a bottom perspective view illustrating an exemplary portable structure (a foldable table, of which the tabletop is in an unfolded state) in accordance with some exemplary embodiments of the present disclosure.
Figure 19:
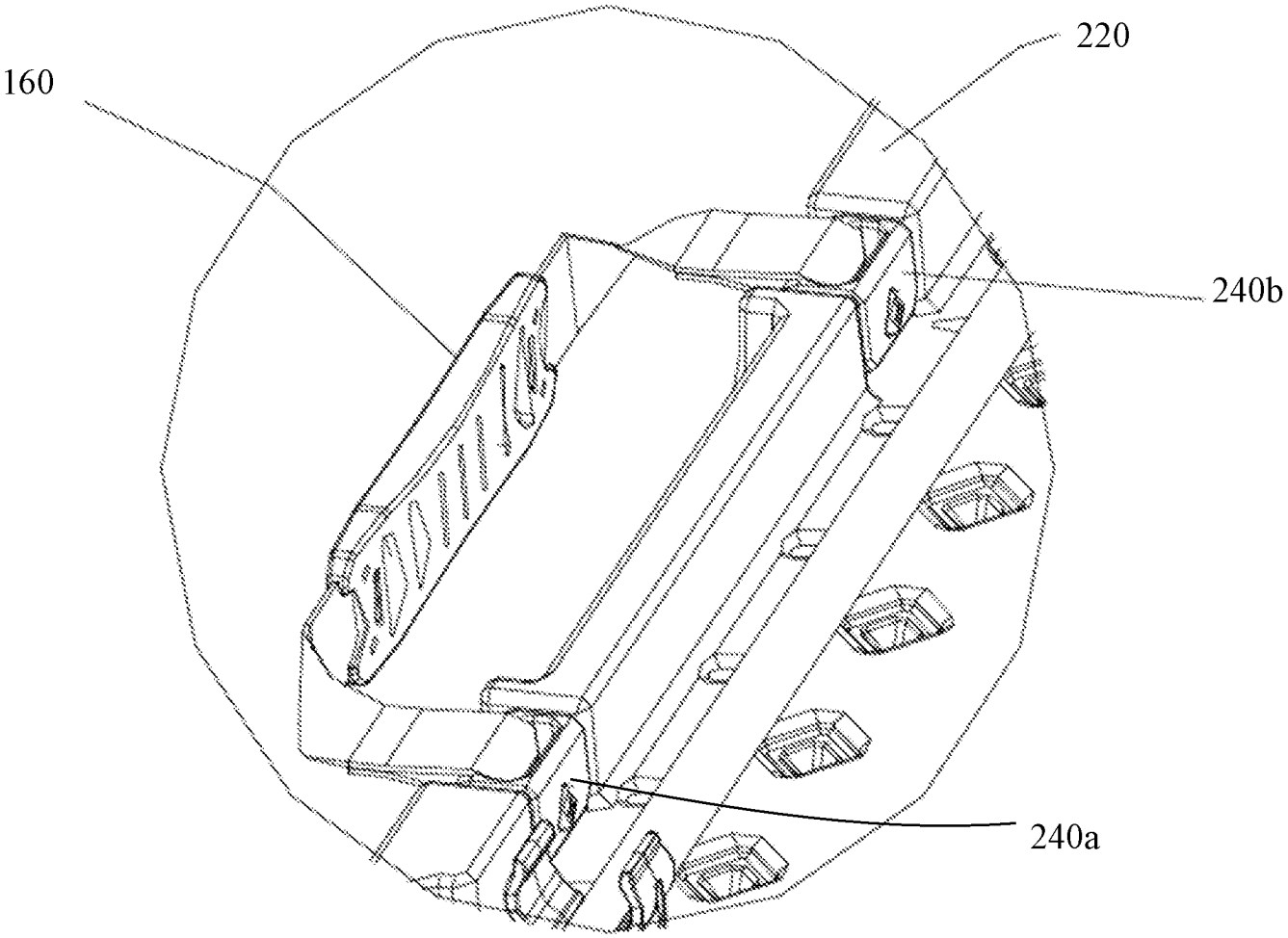
FIG. 19 is an enlarged view taken along circle H of FIG. 18.
Figure 20:
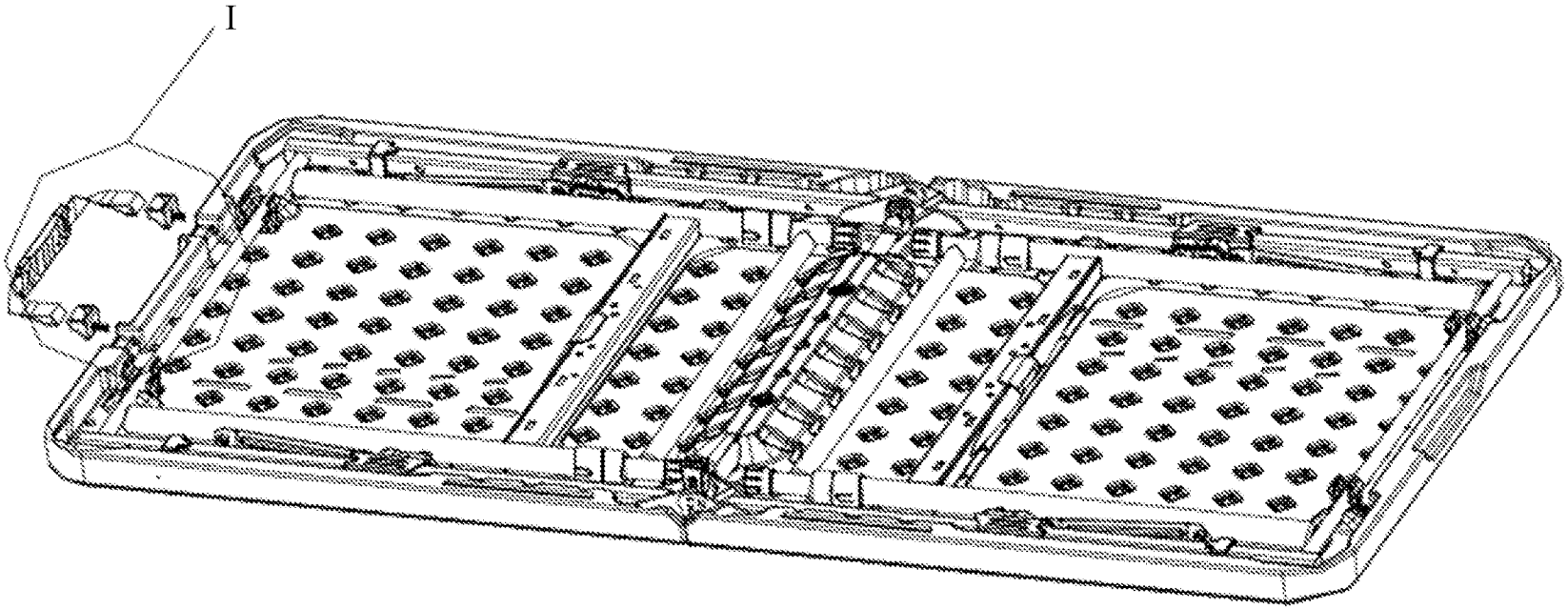
FIG. 20 is a partially disassembled view illustrating the exemplary portable structure of FIG. 18.

Referring to FIGS. 16 and 17, in some exemplary embodiments, a connector bridge such as connector bridge 141 is disposed between first connector 140*a* and second connector 140*b*. The connector bridge is coupled or formed with the first connecting pieces of the first and second connectors. The first connecting piece of each of the first and second connectors can be formed with one slot or two slots. To accommodate the first and second connectors, the ridge can be formed with one, two or more notches. By way of example, FIGS. 16-17 illustrates the ridge is formed with one notch such as notch 128. Like first notch 121*a* or second notch 121*b*, a first lug such as first lug 122*a* is formed at a first side of notch 128, and a second lug such as second lug 122*b* is formed at a second side of the notch.

The first connector is disposed at the first side of the notch and a slot formed at the first connecting piece of the first connector receives the first lug. The second connector is disposed at the second side of the notch and a slot formed at the first connecting piece of the second connector receives the second lug. In an exemplary embodiment, the first connecting piece of the first connector is fixedly coupled with the first lug and the first connecting piece of the second connector is fixedly coupled with the second lug.

In some exemplary embodiments, the handle connecting piece of the first connector is disposed between the slot of the first connector and the connector bridge, and the handle connecting piece of the second connector is disposed between the slot of the second connector and the connector bridge.

In some exemplary embodiments, one or more recesses are formed at the ridge and/or main body adjacent to notch 128 to accommodate second connecting piece 149 of the first or second connector. For instance, a first ridge recess, configured the same as or similar to first ridge recess 126*a*, is formed adjacent to the first lug at notch 128 and the first body surface of the main body to accommodate the first segment of the second connecting piece of the first connector. A first body recess, configured the same as or similar to first body recess 113*a*, is formed adjacent to the first ridge recess to accommodate the second segment of the second connecting piece of the first connector. Similarly, a second ridge recess, configured the same as or similar to second ridge recess 126*b*, is formed adjacent to the second lug at notch 128 and the first body surface of the main body to accommodate the first segment of the second connecting piece of the second connector. A second body recess, configured the same as or similar to second body recess 113*b*, is formed adjacent to the second ridge recess to accommodate the second segment of the second connecting piece of the second connector.

In some exemplary embodiments, the second segment of the second connecting piece of the first or second connector is fixedly coupled with the main body. This reduces the local stresses at the first and second lugs and enhances the strength of the connection.

Referring now to FIGS. 18-22, there is depicted exemplary portable structure 200 in accordance with some exemplary embodiments of the present disclosure. As shown, portable structure 200 includes main body 110, ridge 220, first connector 240*a* and second connector 240*b*, and handle 160. The first and second connectors can be but do not necessarily have to be identical or symmetric with respect to each other. By way of example, FIGS. 18-21 illustrate first connector 240*a* and second connector 240*b* that are substantially the same and disposed symmetrically with respect to each other.

Figure 21:
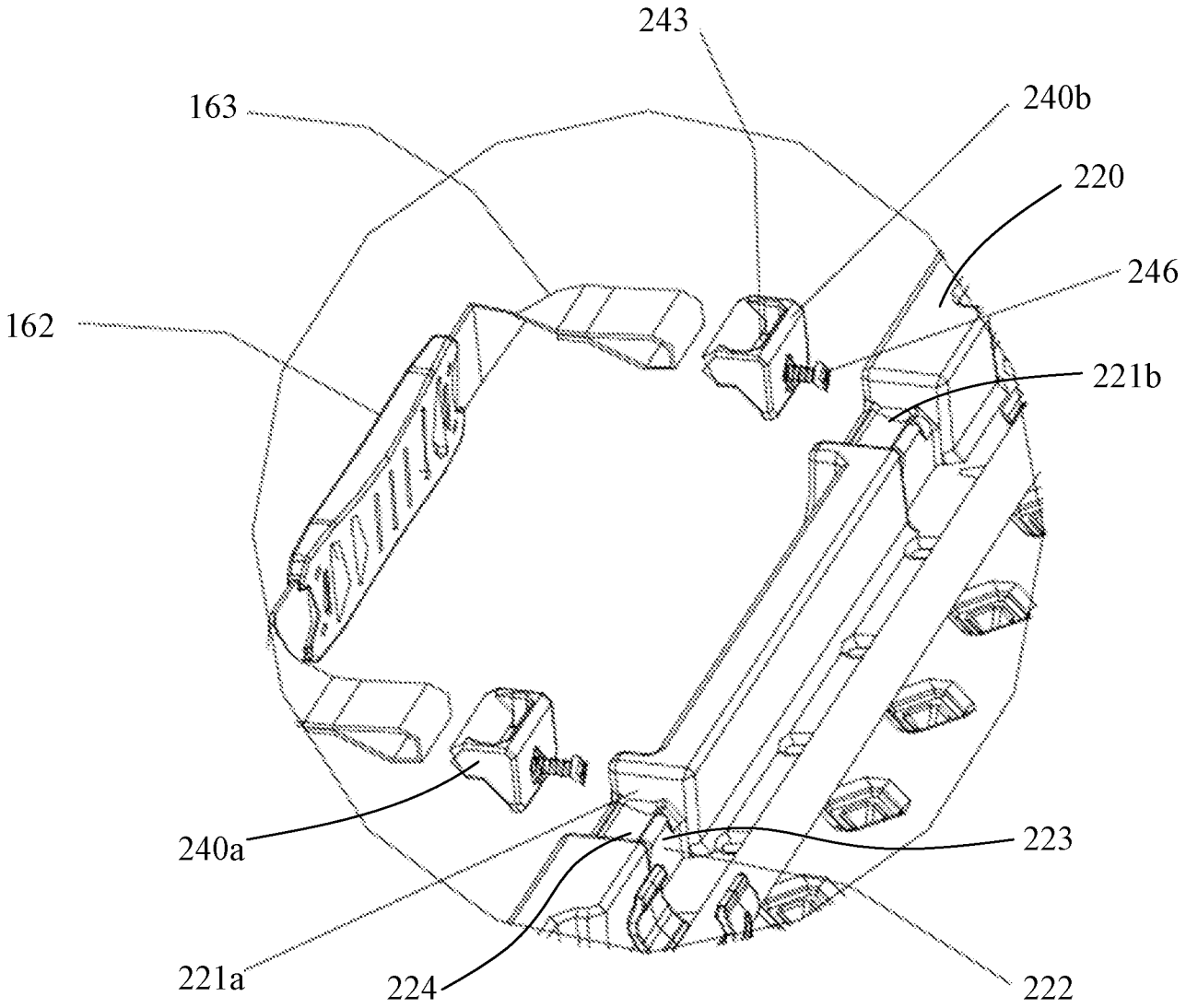
FIG. 21 is an enlarged view taken along circle I of FIG. 20.
Figure 22:
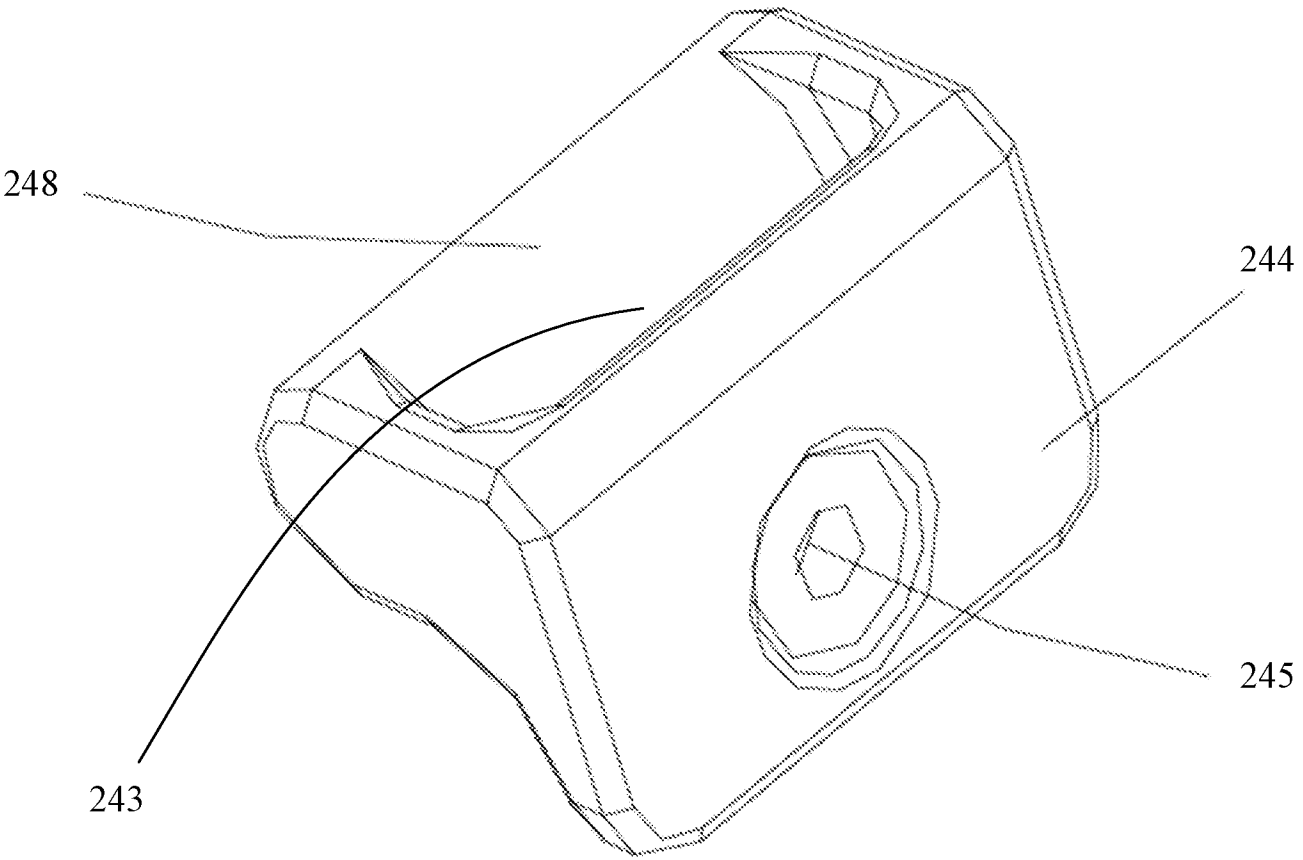
FIG. 22 is a perspective view illustrating an exemplary connector in accordance with some exemplary embodiments of the present disclosure.
Figure 23:
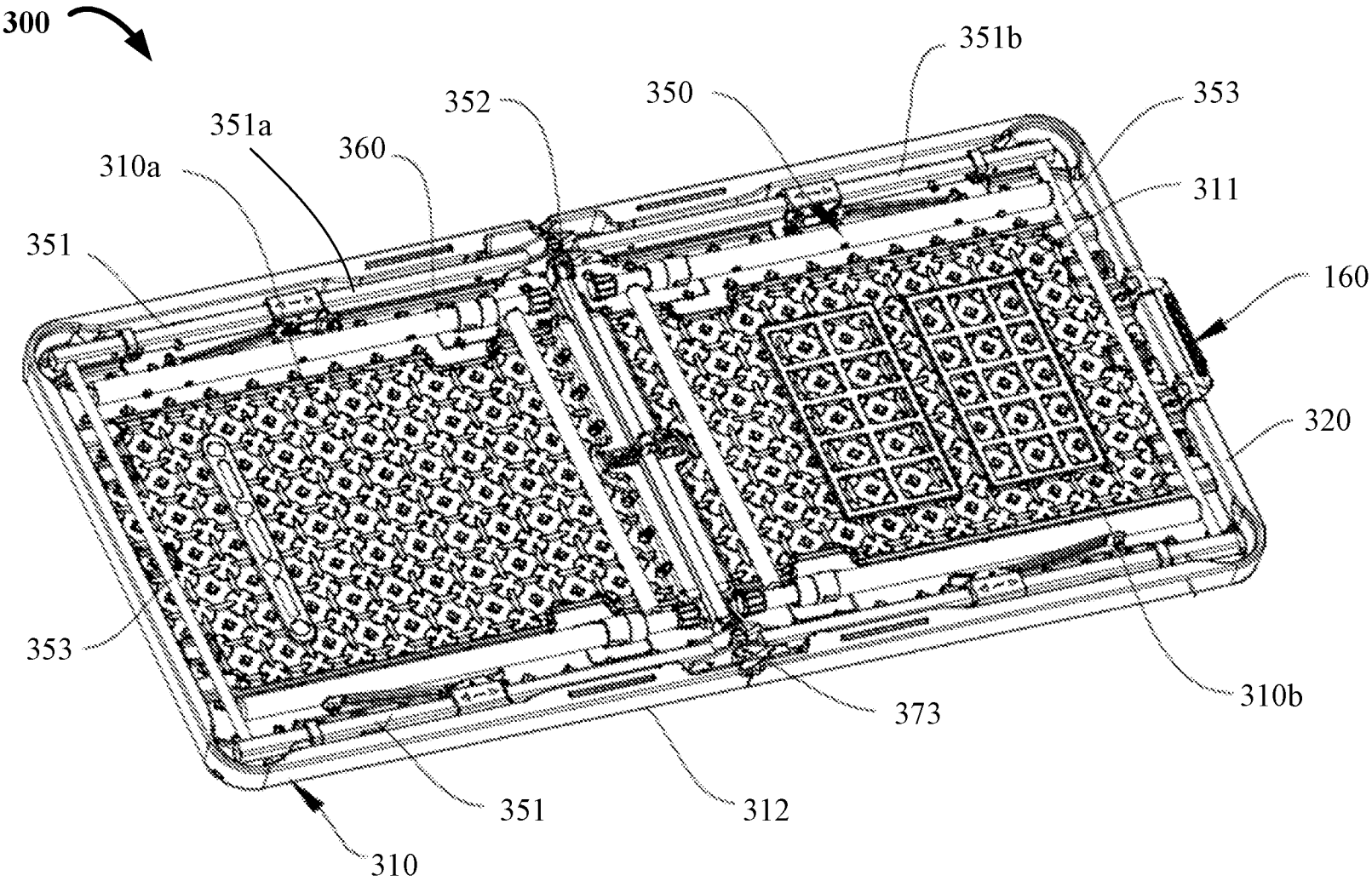
FIG. 23 is a bottom perspective view illustrating an exemplary portable structure (a foldable table, of which the tabletop is in an unfolded state) in accordance with some exemplary embodiments of the present disclosure.
Figure 24:
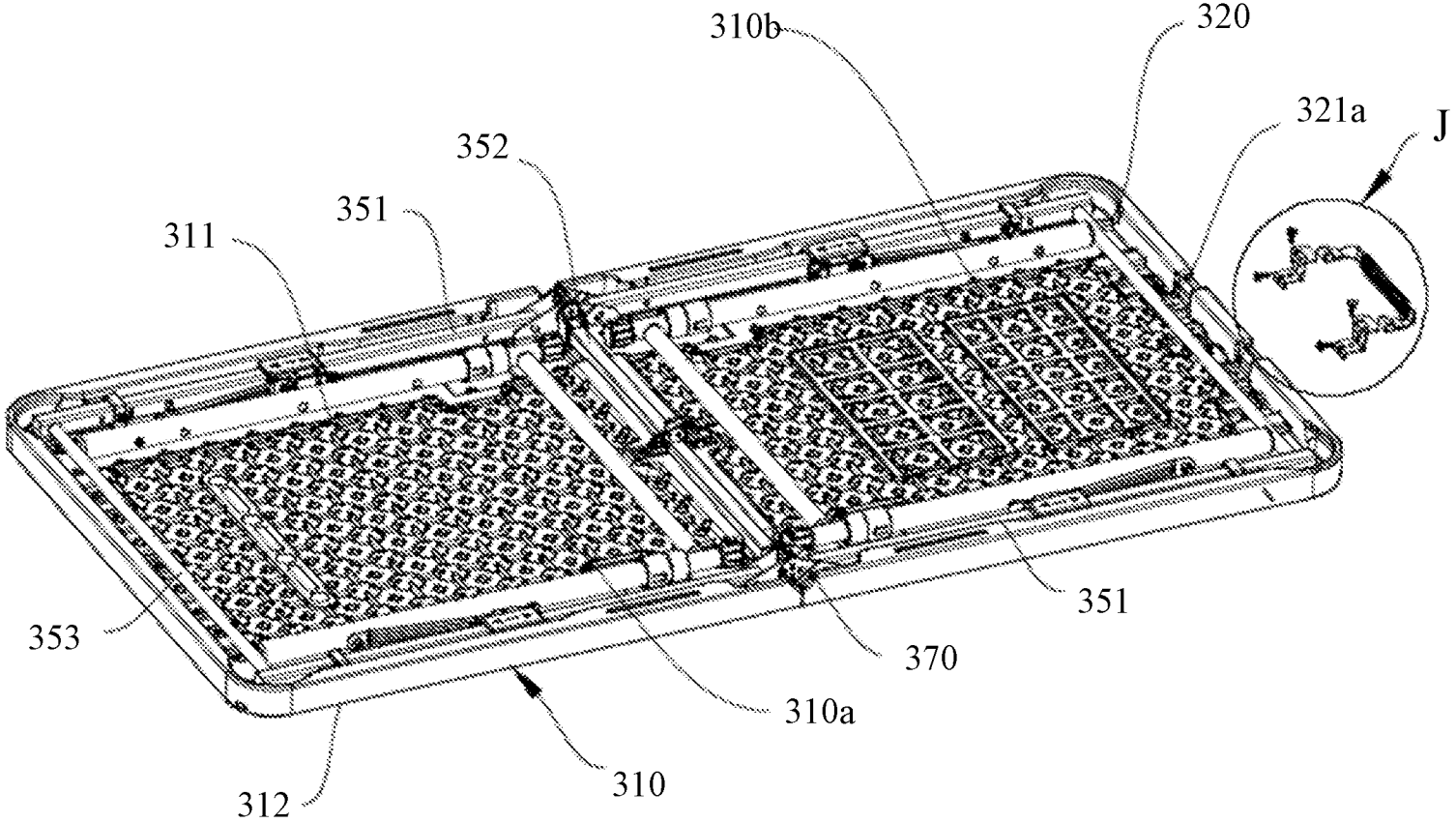
FIG. 24 is a bottom perspective and partially disassembled view illustrating the exemplary portable structure of FIG. 23.

Ridge 220 is coupled or formed with main body 110, and generally extended in a first direction (e.g., the height direction of the table) beyond first body surface 111. In some exemplary embodiments, ridge 220 is formed with a first notch such as first notch 221*a* and a second notch such as second notch 221*b*. The first and second notches can be but do not necessarily have to be identical or symmetric with respect to each other. By way of example, FIG. 21 illustrates first notch 221*a* and second notch 221*b* that are substantially the same and disposed symmetrically with respect to each other.

In some exemplary embodiments, at one or each of the first and second notches, a block such as block 222 is formed at a bottom of the first or second notch. Block 222 includes an interior block surface such as interior block surface 223 and a top block surface such as top block surface 224.

First connector 240*a* and second connector 240*b* are coupled with ridge 220. For instance, in some exemplary embodiments, first connector 240*a* is disposed at first notch 221*a* and second connector 240*b* is disposed at second notch 221*b*. The first or second connector includes a first connecting piece such as first connecting piece 242. First connecting piece 242 includes a side wall, such as side wall 244, that abuts the interior block surface. In an exemplary embodiment, the side wall is fixedly coupled with the block, for instance, by fastener 246 through hole 245 formed at the side wall.

Each of first connector 240*a* and second connector 240*b* also includes a handle connecting piece such as handle connecting piece 248. Handle connecting piece 248 is coupled or formed with first connecting piece 242. In some exemplary embodiments, handle connecting piece 248 is spaced apart from side wall 244 of the first connecting piece, thereby forming an opening such as opening 243 between the handle connecting piece and the side wall of the first connecting piece.

In some exemplary embodiments, the handle connecting piece is disposed at or adjacent to the top block surface, and the top block surface is dented toward the bottom of the first or second notch to accommodate the handle connecting piece of the first or second connector.

The first attachment portion of the handle passes through opening 243 of the first connector and, cross-sectional-wise, surrounds handle connecting piece 248 of the first connector. Similarly, the second attachment portion of the handle passes through opening 243 of the second connector and, cross-sectional-wise, surrounds the handle connecting piece of the second connector.

Referring to FIGS. 23-32, there is depicted exemplary portable structure 300 in accordance with some exemplary embodiments of the present disclosure. As shown, portable structure 300 includes main body 310, ridge 320, handle 160, first connector 340*a* and second connector 340*b*. The first and second connectors can be but do not necessarily have to be identical or symmetric with respect to each other. By way of example, FIGS. 23-27 illustrate first connector 340*a* and second connector 340*b* that are substantially the same and disposed symmetrically with respect to each other.

Similar to main body 110, main body 310 has a first body surface such as surface 311 (e.g., the lower surface of the table panel) and a second body surface such as surface 312 (e.g., the upper surface of the table panel). The first or second body surface can be planar or curved or composed of planar and curved sections. Also, the first or second body surface can include other features such as depressions, protrusions or the like. In an exemplary embodiment, the main body is made by blow molding of a plastic and has a generally hollow interior between the first and second body surfaces.

Similar to ridge 120, ridge 320 is coupled or formed with main body 310, and generally extended in a first direction (e.g., the height direction of the table) beyond first body surface 311. In some exemplary embodiments, ridge 320 is formed with a first notch such as first notch 321*a* and a second notch such as second notch 321*b*. The first and second notches can be but do not necessarily have to be identical or symmetric with respect to each other. By way of example, FIGS. 24-27 illustrate first notch 321*a* and second notch 321*b* that are substantially the same and disposed symmetrically with respect to each other.

In some exemplary embodiments, at one or each of the first and second notches, a block such as block 322 is formed at a bottom of the first or second notch. Block 322 includes an interior block surface such as interior block surface 323 and a top block surface such as top block surface 324.

First connector 340*a* and second connector 340*b* are coupled with ridge 320. For instance, in some exemplary embodiments, first connector 340*a* is disposed at first notch 321*a* and second connector 340*b* is disposed at second notch 321*b*. Each of connector 340*a* and second connector 340*b* includes a first connecting piece, such as first connecting piece 341. In some exemplary embodiments, first connecting piece 341 is fixedly coupled with block 322, for instance, by fastener 146 via hole 346.

Each of first connector 340*a* and second connector 340*b* also includes a handle connecting piece such as handle connecting piece 348. Handle connecting piece 348 is coupled or formed with first connecting piece 341. In some exemplary embodiments, each of first connector 340*a* and second connector 340*b* includes at least one opening, such as opening 343, formed at the first connecting piece so that the handle connecting piece is accessible from the outside through the at least one opening formed at the first connecting piece. For instance, the first attachment portion of the handle passes through opening 343 of the first connector and, cross-sectional-wise, surrounds handle connecting piece 348 of the first connector. Similarly, the second attachment portion of the handle passes through opening 343 of the second connector and, cross-sectional-wise, surrounds the handle connecting piece of the second connector. In some exemplary embodiments, each of first connector 340*a* and second connector 340*b* includes two openings. In an exemplary embodiment, an opening is a cutout slot.

Figure 25:
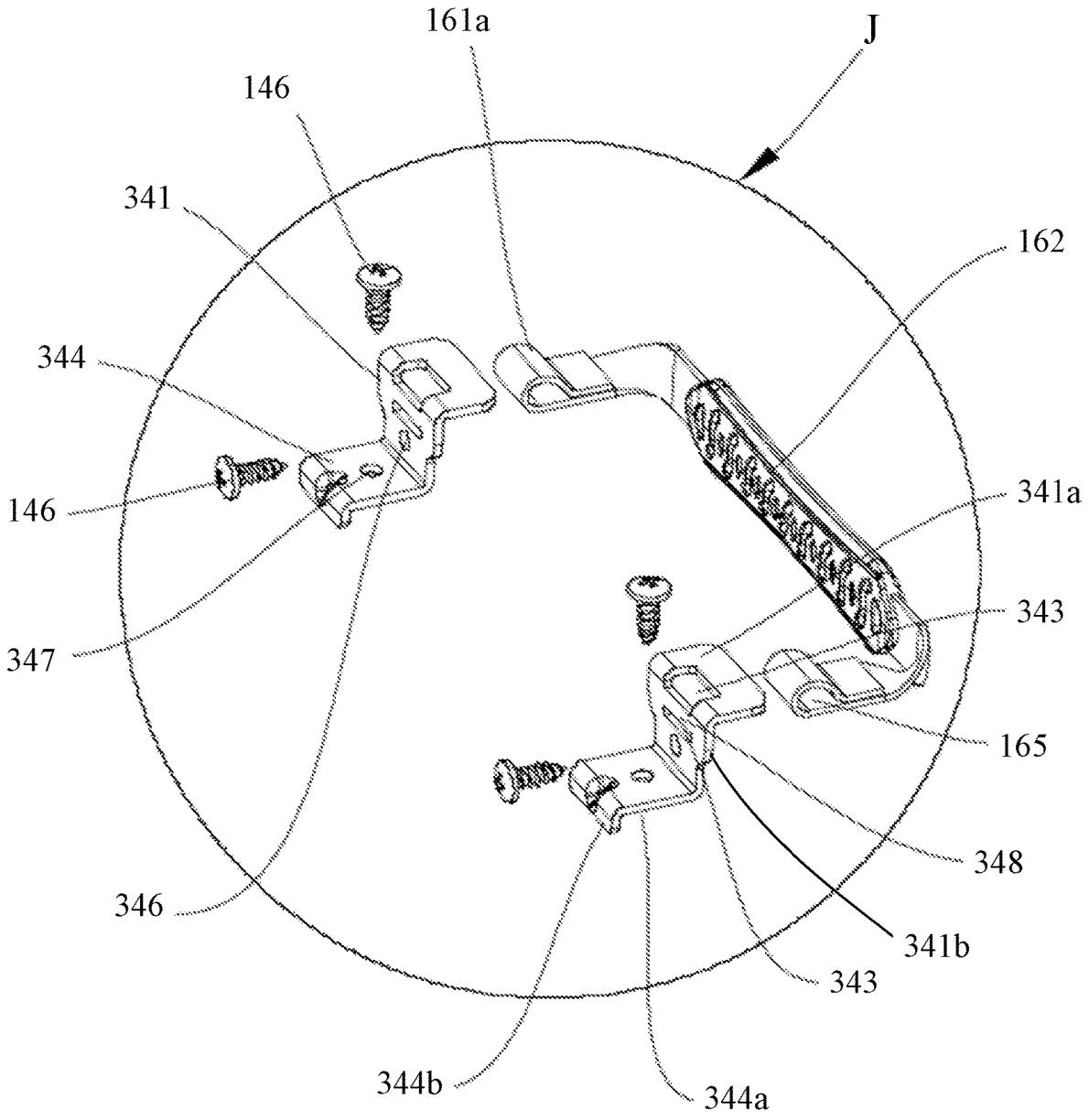
FIG. 25 is an enlarged view taken along circle J of FIG. 24.
Figure 27:
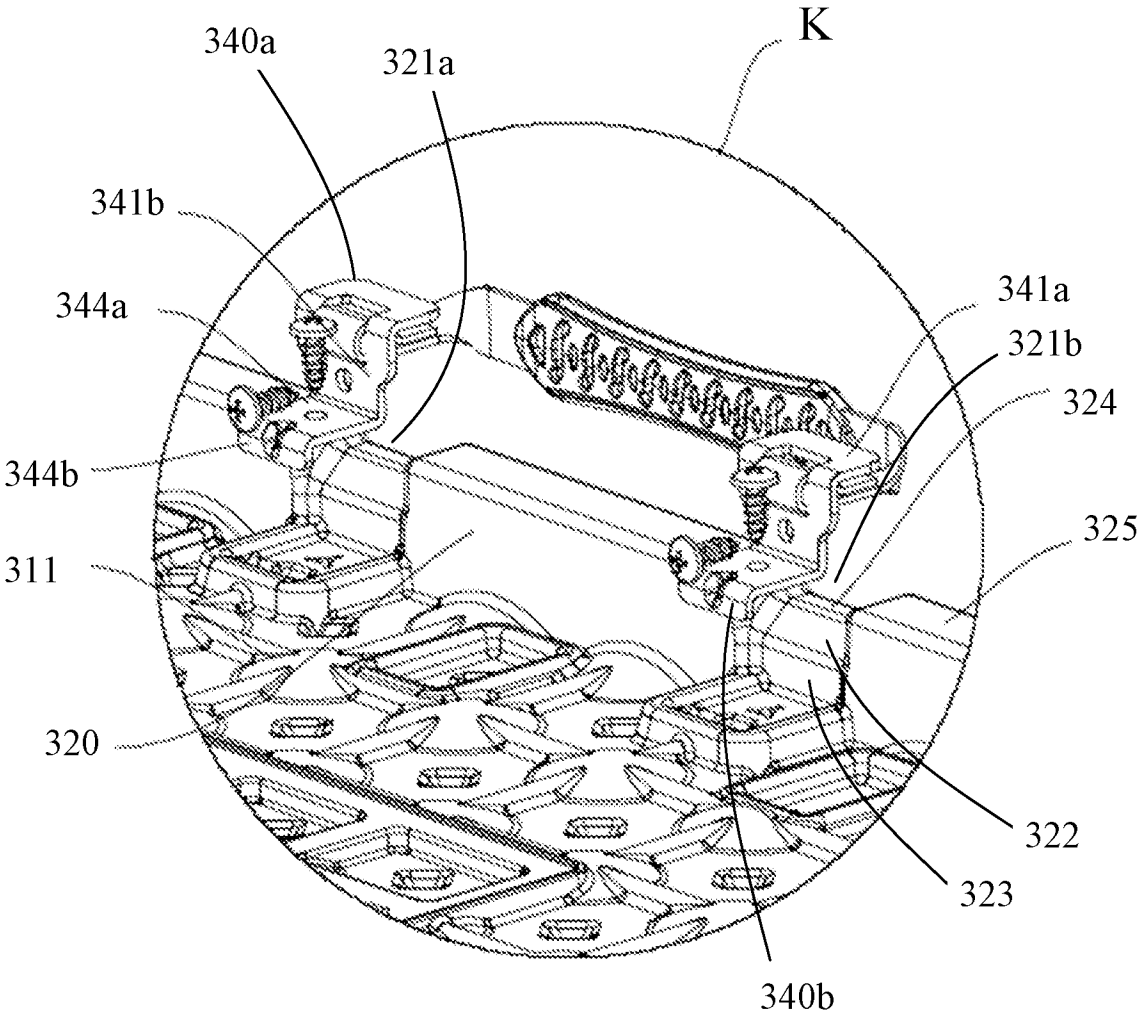
FIG. 27 is an enlarged view taken along circle K of FIG. 26.
Figure 30:
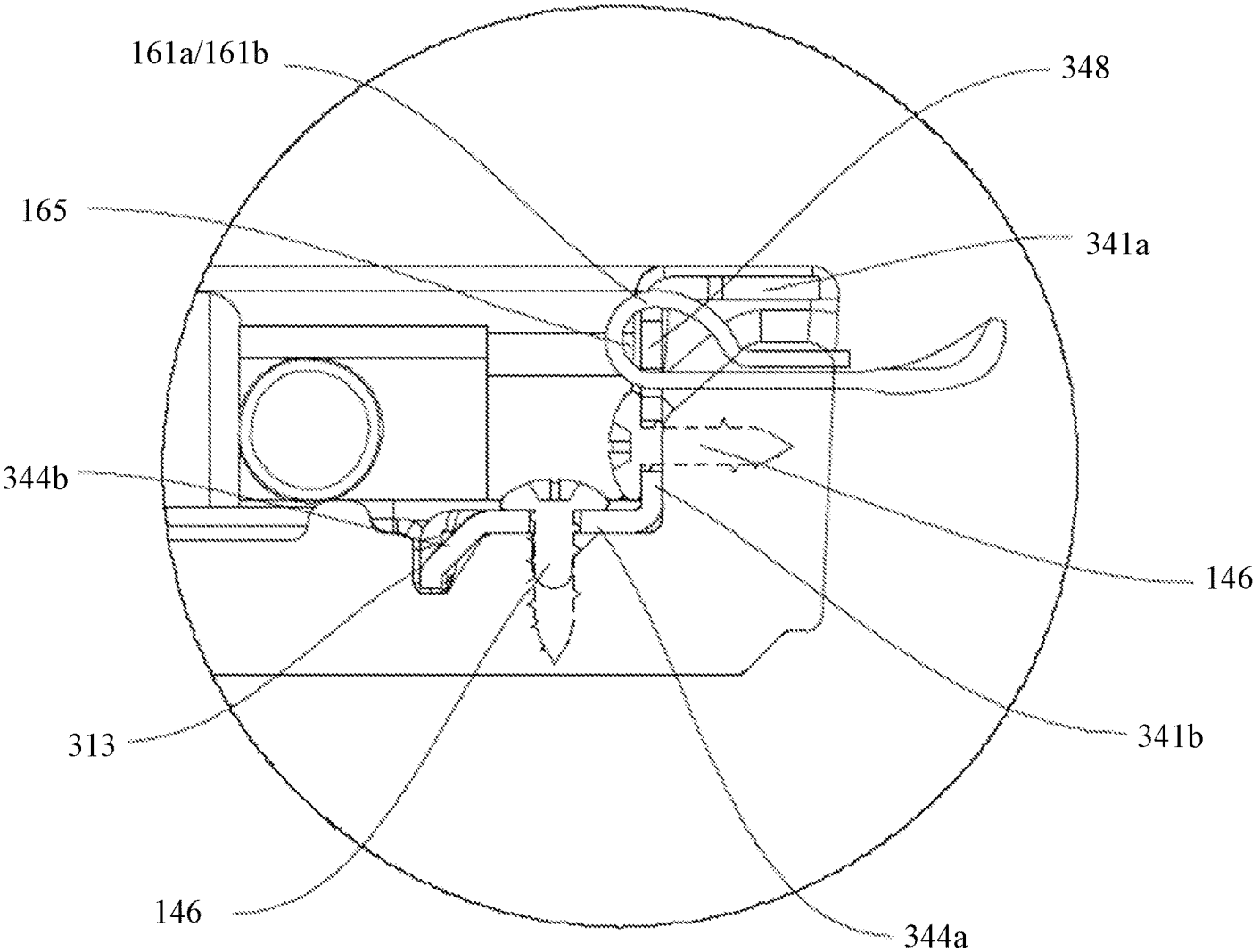
FIG. 30 is an enlarged view taken along circle M of FIG. 29.

Referring in particular to FIGS. 25, 27 and 30, in some exemplary embodiments, first connecting piece 341 includes multiple segments such as first segment 341*a* and second segment 341*b*. Generally, the first segment of first connecting piece 341 is disposed on the top block surface of block 322, and the second segment of first connecting piece 341 is disposed beside the interior block surface of block 322. In some exemplary embodiments, at least a portion of the first or second attachment portion of the handling is disposed between the first segment of first connecting piece 341 and the top block surface of block 322 formed at the bottom of the first or second notch. The first segment of first connecting piece 341 retains the first or second attachment portion of the handling at the top block surface of block 322, preventing it from dangling or moving away from the block. This improves the reliability of the handle and enhances the aesthetics of the table.

In some exemplary embodiments, the first segment of the first connecting piece 341 is aligned substantially with a top ridge surface, such as top ridge surface 325, adjacent to the first or second notch. This further improves the reliability of the handle and enhances the aesthetics of the table.

In some exemplary embodiments, each of first connector 340*a* and second connector 340*b* also includes a second connecting piece, such as second connecting piece 344. Second connecting piece 344 is coupled or formed with first connecting piece 341. In an exemplary embodiment, second connecting piece 344 is fixedly coupled with main body 310, for instance, by fastener 146 via hole 347. The second connecting piece connects the handle to the main body. It helps distribute the load to the main body and thus reduce localized high stresses. This further improves the reliability of the handle.

In some exemplary embodiments, second connecting piece 344 includes multiple segments such as first segment 344*a* and second segment 344*b*. First segment 344*a* is formed or coupled with first connecting piece 341. For instance, in some exemplary embodiments, first segment 344*a* is formed or coupled with second segment 341*b* of first connecting piece 341. Second segment 344*b* is extended from first segment 344*a* and often at an angle with respect to first segment 344*a*. Generally, first segment 344*a* is disposed on the first body surface of the main body while at least a portion of second segment 344*b* is disposed at a receptacle, such as receptacle 313, formed at the main body. In some exemplary embodiments, the angle between first segment 344*a* and second segment 344*b* is about 50 to 150 (e.g., about 50, 60, 70, 80, 90, 100, 110, 120, 130, 140 or 150) degrees. In an exemplary embodiment, first segment 344*a* of the second connecting piece is substantially perpendicular to second segment 341*b* of the first connecting piece, and second segment 344*b* of the second connecting piece is substantially perpendicular to first segment 344*a* of the second connecting piece.

Referring to FIGS. 23-24, 26 and 31-32, in some exemplary embodiments, structure 300 is a foldable table. The tabletop of the foldable table includes two or more table panels, each panel including a main body such as first main body 310*a* or second main body 310*b*. The tabletop is coupled to and supported by a supporting frame, such as supporting frame 350. Examples of supporting frames are disposed in U.S. patent application Ser. No. 17/142,711 and U.S. patent application Ser. No. 16/838,939, the disclosure of each application is incorporated herein for all purposes by reference in its entirety. In some exemplary embodiments, a panel (e.g., a main body along with other features such as one or more ridges disclosed herein) is a unitary piece formed by blow molding plastics such as high density polyethylene (HDPE), low density polyethylene (LDPE), polypropylene (PP), polyvinyl chloride (PVC), polyethylene terephthalate (PET), thermoplastic elastomers (TPE), or the like.

In some exemplary embodiments, the supporting frame includes first and second mounting longitudinal bars, such as mounting longitudinal bar 351, spaced apart in a lateral direction of the table. The first and second mounting longitudinal bars can be but do not necessarily have to be identical or symmetric with respect to each other. Each of the first and second mounting longitudinal bars includes a first bar segment, such as first bar segment 351*a*, and a second bar segment, such as second bar segment 351*b*. The first and second bar segments are pivotally connected with each other at their proximal ends by a folding/unfolding mechanism, such as folding/unfolding mechanism 370. Examples of folding/unfolding mechanisms are disposed in U.S. patent application Ser. No. 16/838,939, the disclosure of the application is incorporated herein for all purposes by reference in its entirety. As used herein, the sides at which the first and second bar segments are connected to each other are referred to as their proximal sides, and the sides opposite the proximal sides are referred to as their distal sides. For instance, in FIG. 23, the proximal sides of the first and second bar segments are in the middle of the foldable table. The distal sides correspond to the lower-left and upper-right sides of the figure. It should be noted that the term "middle" as used herein does not necessarily mean the center of the frame, and the term "side" does not necessarily mean an outmost edge of the frame.

Figure 26:
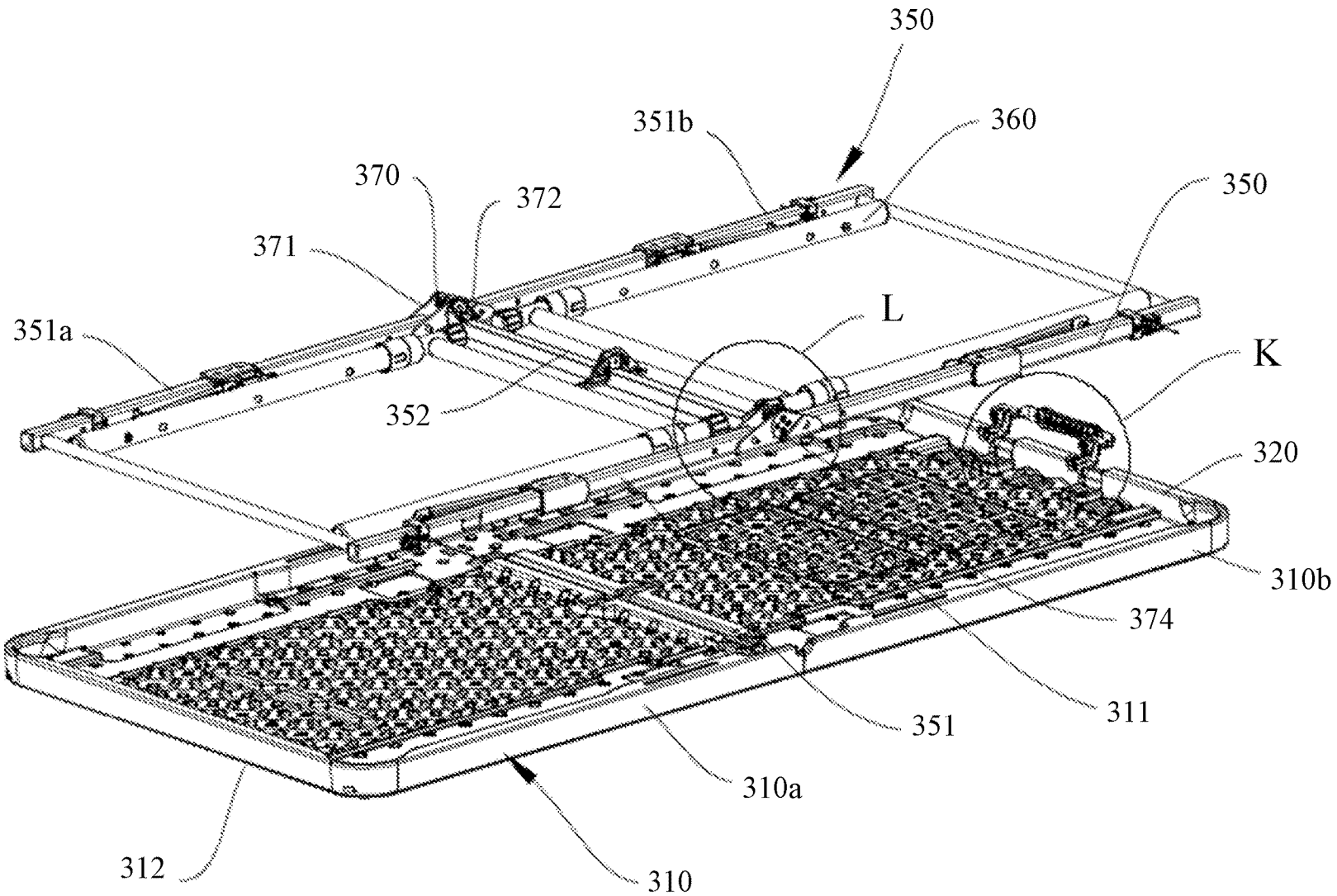
FIG. 26 is a bottom perspective and partially disassembled view illustrating the exemplary portable structure of FIG. 23.
Figure 28:
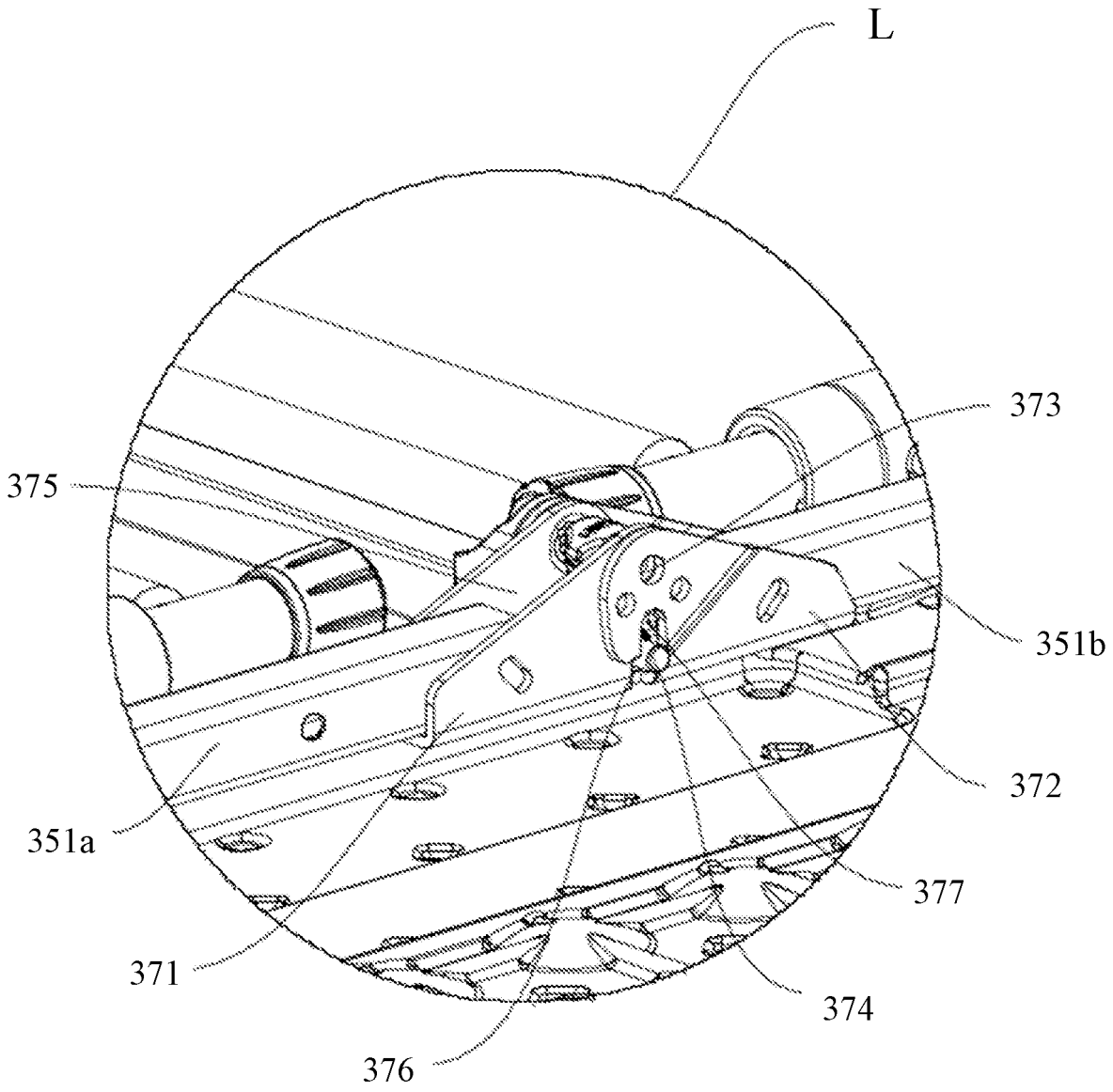
FIG. 28 is an enlarged view taken along circle L of FIG. 26.
Figure 29:
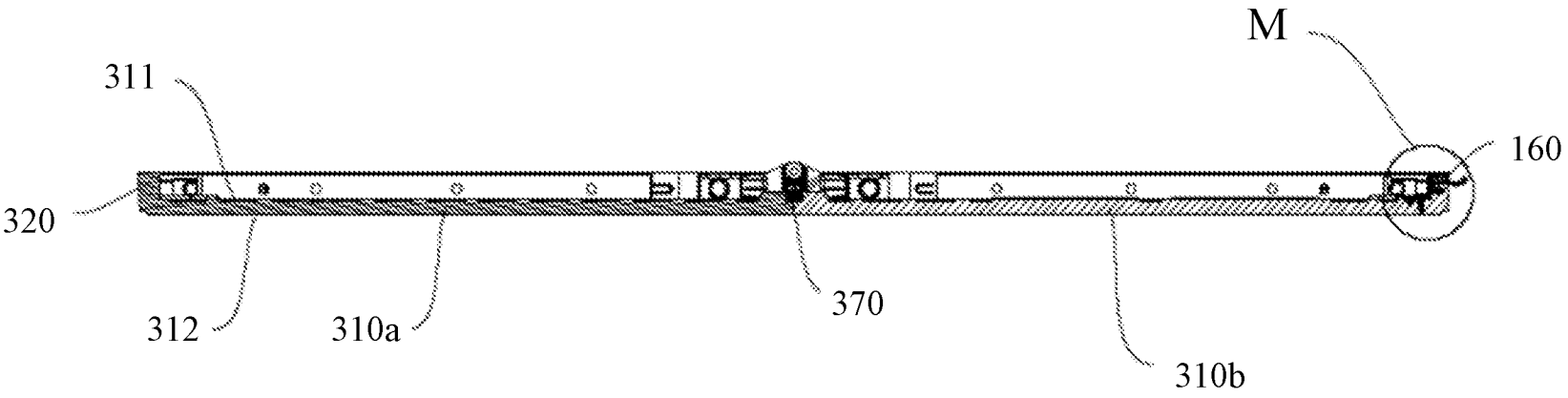
FIG. 29 is a schematic cross-sectional view illustrating the exemplary portable structure of FIG. 23.

Referring in particular to FIGS. 26 and 28, in some exemplary embodiments, folding/unfolding mechanism 370 includes a first coupling piece such as first coupling piece 371, a second coupling piece such as second coupling piece 372, a first rod such as first rod 373 and a second rod such as second rod 374. First coupling piece 371 is configured to be fixedly coupled with the proximal end of first bar segment 351*a*, and second coupling piece 372 is configured to be fixedly coupled with the proximal end of second bar segment 351*b*, for instance, by welding, bolting or the like. In some exemplary embodiments, the first or second coupling piece includes a receptacle, such as receptacle 375, to receive the proximal end of the first or second bar segment. The first and second coupling pieces are pivotally coupled with each other by first rod 373.

In some exemplary embodiments, first coupling piece 371 is formed with a first slot, such as first slot 376. Cross-sectional-wise, second rod 374 is disposed in the first slot. The first slot is generally elongated in the height direction of the table and has both closed bottom and closed top. The second rod is movable along the first slot, for instance, by gravity. Second coupling piece 372 is formed with a second slot, such as second slot 377. Second slot 377 has a closed bottom and an open top. When unfolded, the first and second slots are aligned with each other. When the table is unfolded and upright, the second rod moves, by gravity or other forces (e.g., manually), to the bottoms of the first and second slots. At this position, the second rod engages the first and second coupling pieces and restricts them from rotating with respect to each other. When the table is unfolded and upside down, the second rod moves, by gravity or other forces (e.g., manually), to the tops of the first and second slots. Because the second slot has an open top, the second rod releases from the second coupling piece and thus allows the first and second coupling pieces to rotate with respect to each other.

Figure 31:
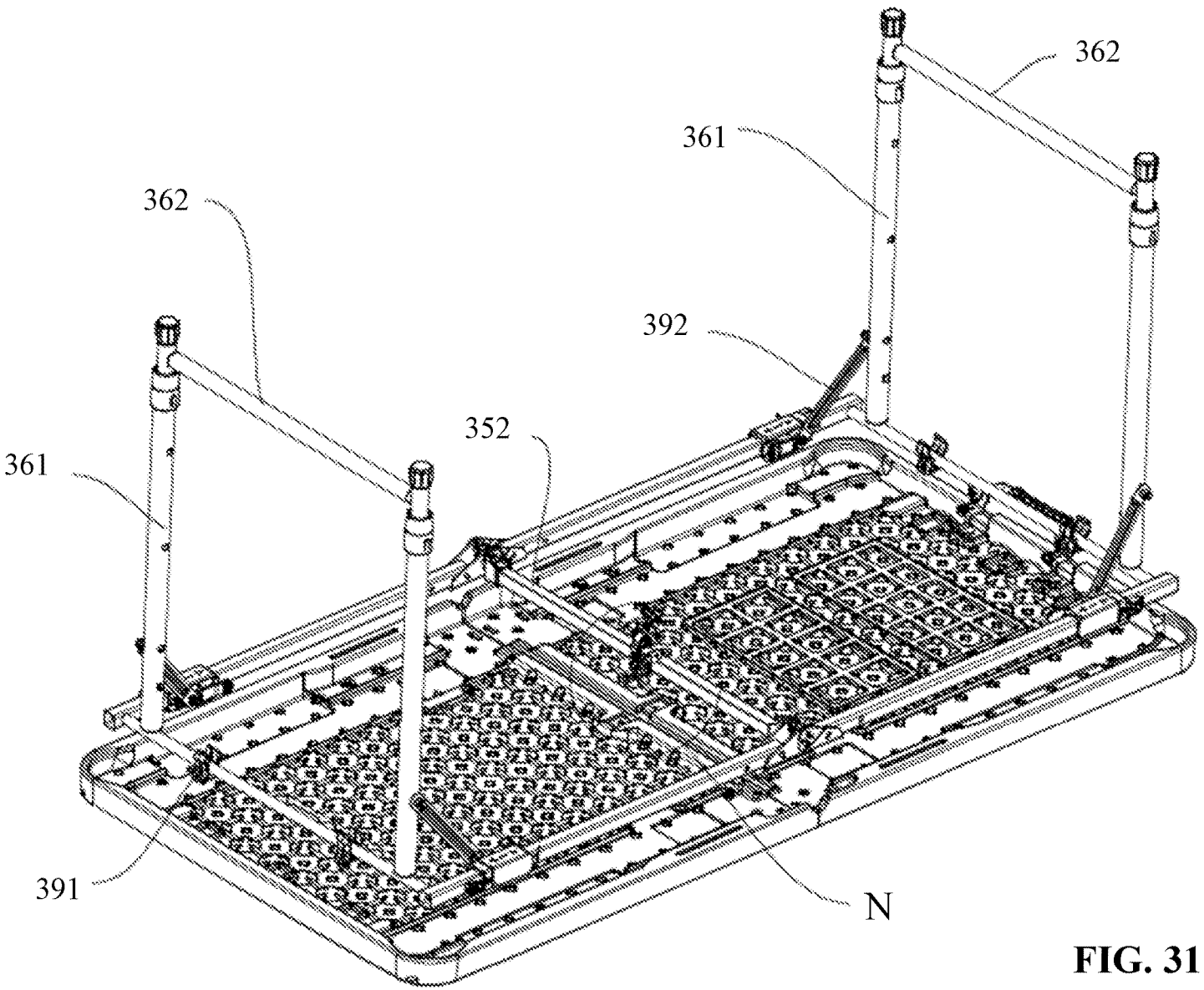
FIG. 31 is a bottom perspective and partially disassembled view illustrating the exemplary portable structure of FIG. 23.
Figure 32:
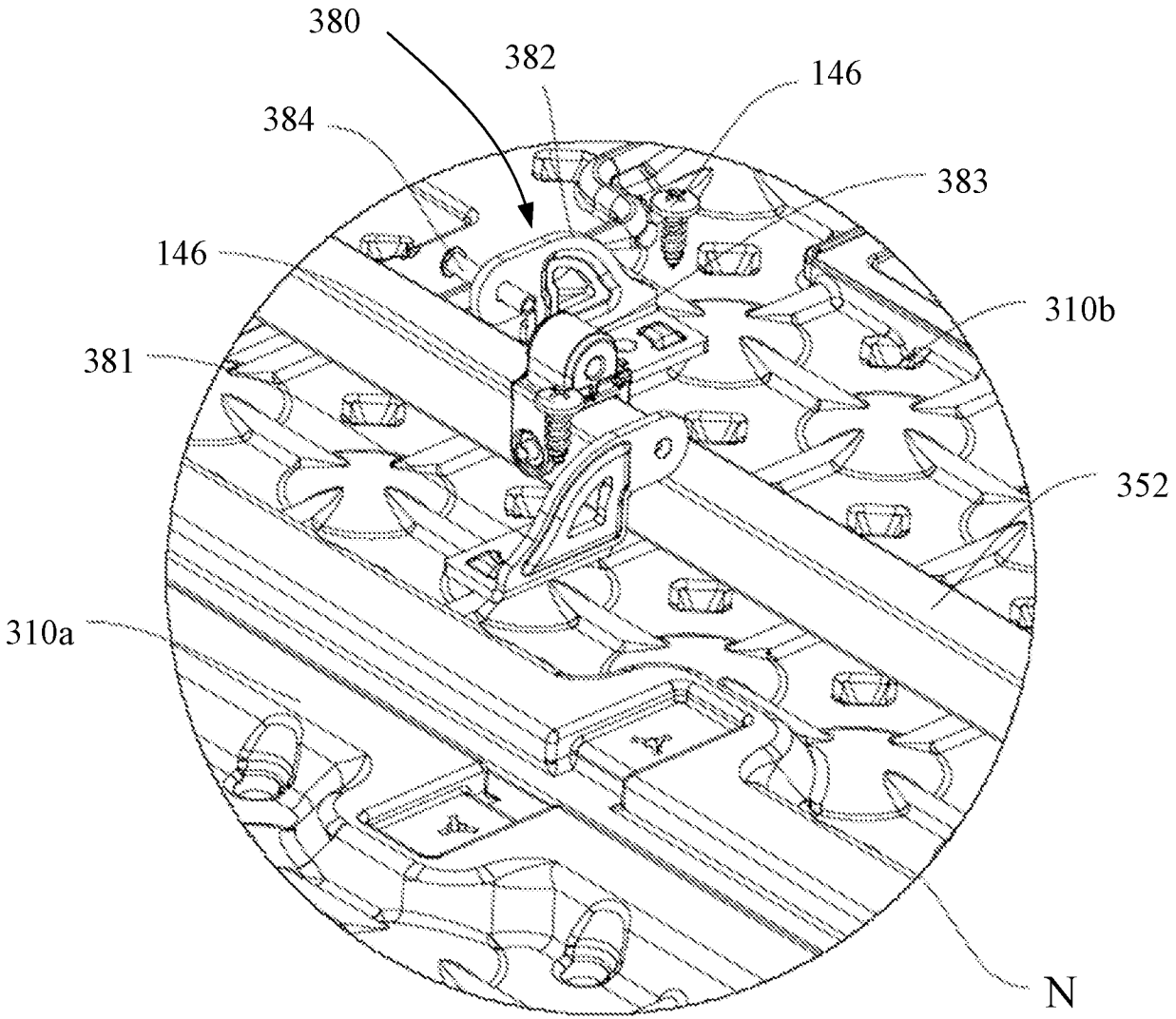
FIG. 32 is an enlarged view taken along circle N of FIG. 31.

Referring in particular to FIGS. 31-32, in some exemplary embodiments, supporting frame 350 also includes a middle lateral bar, such as middle lateral bar 352. The middle lateral bar is disposed between the first and second mounting longitudinal bars at the proximal sides of the first and second bar segments. The middle lateral bar is connected to the first bar segment, second bar segment or folding/unfolding mechanism.

In some exemplary embodiments, the middle lateral bar is coupled with the first and second main bodies by an auxiliary folding/unfolding mechanism, such as auxiliary folding/unfolding mechanism 380. In some exemplary embodiments, the auxiliary folding/unfolding mechanism includes multiple auxiliary coupling pieces, such as first auxiliary coupling piece 381, second auxiliary coupling piece 382 and third auxiliary coupling piece 383. The first auxiliary coupling piece is formed with the first main body, or fixedly coupled with the first main body, for instance by a fastener such as fastener 146. The second auxiliary coupling piece is formed with the second main body, or fixedly coupled with the second main body, for instance by a fastener such as fastener 146. The third auxiliary coupling piece is fixedly coupled with the middle lateral bar. In an exemplary embodiment, the third auxiliary coupling piece is disposed between the first and second auxiliary coupling pieces in the lateral direction of the table. The first, second and third auxiliary coupling pieces are pivotally coupled with each other by an auxiliary rod, such as auxiliary rod 384.

Generally, auxiliary rod 384 of the auxiliary folding/unfolding mechanism is aligned with first rod 373 of the folding/unfolding mechanism. This allows the table panels (e.g., the first and second main bodies) to fold and unfold with respect to each other. In addition, the auxiliary folding/unfolding mechanism helps distribute the load more evenly to the components of the supporting frame and thus prolong its service life.

In some exemplary embodiments, supporting frame 350 further includes first and second lateral bars, such as lateral bar 353, disposed between the first and second mounting longitudinal bars. The first lateral bar is connected to the first bar segments of the first and second mounting longitudinal bars. The second lateral bar is connected to the second bar segments of the first and second mounting longitudinal bars.

In some exemplary embodiments, supporting frame 350 also includes first and second leg assemblies, such as leg assembly 360. The first leg assembly is connected to the first lateral bar (e.g., lateral bar 353) and rotatable with respect to the first main body. The second leg assembly is connected to the second lateral bar (e.g., lateral bar 353) and rotatable with respect to the second main body. In some exemplary embodiments, cross-sectional-wise, at least a portion of the first or second lateral bar is disposed in a slot of a retainer, such as retainer 391. Examples of retainers are disposed in U.S. patent application Ser. No. 16/839,337, the disclosure of the application is incorporated herein for all purposes by reference in its entirety. The retainer is fixedly coupled or integrally formed with the first or second main body. The retainer aids the rotation of the lateral bar and leg assembly and enhances the stability and reliability of the supporting frame. In an exemplary embodiment, two or more retainers are fixedly coupled or integrally formed with the first or second main body to aid the rotation of the lateral bar and leg assembly.

In an exemplary embodiment, leg assembly 360 includes two legs, such as leg 361, and a leg lateral bar, such as leg lateral bar 362. The leg lateral bar is generally disposed between and connected to the two legs. In some exemplary embodiments, one or more linking mechanisms, such as linking mechanism 392, are used to connect the first or second leg assembly with the first or second mounting longitudinal bar. The one or more linking mechanisms help stabilize the leg assembly and support the tabletop.

The components disclosed herein are combinable in any useful number and combination. For instance, any combination of connectors 140*a*, 140*b*, 240*a*, 240*b*, 340*a* and 340*b* can be used together to connect a handle to a portable structure. As another example, first connector 240*a* or second connector 240*b* can be modified to include a second connecting piece such as second connecting piece 149 disclosed herein.

As disclosed herein, each of the first and second connectors form multiple contacts and/or connections with the ridge, main body and/or mounting bar of the supporting frame. For instance, in some exemplary embodiments, the first connecting piece of each connector abuts the ridge (e.g., the first and second lugs or the block) and the second connecting piece of each connector abuts the ridge, main body and/or mounting bar. As such, the load is transferred to and distributed over several components and, accordingly, the local stresses are reduced and the strength of the connection are enhanced.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first segment could be termed a second segment, and, similarly, a second segment could be termed a first segment, without changing the meaning of the description, so long as all occurrences of the "first segment" are renamed consistently and all occurrences of the "second segment" are renamed consistently.

What is claimed is:

1. A portable structure comprising:

a main body having a first body surface and a second body surface;

a ridge coupled or formed with the main body and extended in a first direction beyond the first body surface;

first and second connectors, each comprising:

a first connecting piece connected to the ridge;

a handle connecting piece coupled or formed with the first connecting piece; and at least one opening to allow access of the handle connecting piece from an outside;

a handle comprising:

a first attachment portion passing through the at least one opening of the first connector and, cross-sectional-wise, surrounding the handle connecting piece of the first connector;

a second attachment portion passing through the at least one opening of the second connector and, cross-sectional-wise, surrounding the handle connecting piece of the second connector; and a gripping portion between the first and second attachment portions to facilitate grasping of the handle.

2. The portable structure of claim 1, wherein the handle comprises a strap made of a flexible material, wherein the first attachment portion of the handle is formed from a first end portion of the strap and the second attachment portion of the handle is formed from a second end portion of the strap.

3. The portable structure of claim 1, wherein the ridge is formed with a first notch and a second notch, the first connector is disposed at the first notch and the second connector is disposed at the second notch.

4. The portable structure of claim 3, wherein a first lug is formed at a first side of the first notch, and a second lug is formed at a second side of the first notch;

the first connecting piece of the first connector is formed with a first slot to receive the first lug and a second slot to receive the second lug; and the first connecting piece of the first connector is fixedly coupled with the first and second lugs at the first notch of the ridge.

5. The portable structure of claim 4, wherein the handle connecting piece of the first connector is disposed between the first and second slots of the first connecting piece of the first connector; and the first and second lugs at the first notch are spaced apart from each other, thereby creating a space in between to accommodate the handle connecting piece of the first connector.

6. The portable structure of claim 4, wherein the ridge comprises an exterior ridge surface, an interior ridge surface spaced apart from the exterior ridge surface, a top ridge surface connecting the exterior and interior ridge surfaces, and a height measured from the top ridge surface to the first body surface;

the first notch comprises a notch depth, measured from the top ridge surface to a bottom surface of the first notch, that is smaller than the height of the ridge;

a first ridge recess is formed adjacent to the first notch and the first body surface of the main body, and recessed from the interior ridge surface toward the exterior ridge surface;

a first body recess is formed adjacent to the first ridge recess and recessed from the first body surface toward the second body surface; and the first connector further comprises a second connecting piece coupled or formed with the first connecting piece, the second connecting piece comprising a first segment disposed at the first ridge recess and a second segment disposed at the first body recess.

7. The portable structure of claim 6, wherein the first segment of the second connecting piece is aligned substantially with the interior surface of the ridge adjacent to the first ridge recess, and the second segment of the second connecting piece is aligned substantially with the first body surface of the main body adjacent to the first body recess.

8. The portable structure of claim 6, wherein the second connecting piece of the first connector further comprises a third segment, wherein cross-sectional-wise, the first, second and third segments of the second connecting piece collectively form a substantial U-shape or a substantial arc shape to receive a mounting bar.

9. The portable structure of claim 4, wherein:

the ridge comprises an exterior ridge surface, an interior ridge surface spaced apart from the exterior ridge surface, a top ridge surface connecting the exterior and interior ridge surfaces, and a height measured from the top ridge surface to the first body surface;

each of the first and second notches comprises a notch depth, measured from the top ridge surface to a bottom surface of the first or second notch, that is smaller than the height of the ridge;

a first ridge recess is formed adjacent to the first notch and the first body surface of the main body, and recessed from the interior ridge surface toward the exterior ridge surface;

a first body recess is formed adjacent to the first ridge recess and recessed from the first body surface toward the second body surface;

a second ridge recess is formed adjacent to the second notch and the first body surface of the main body, and recessed from the interior ridge surface toward the exterior ridge surface;

a second body recess is formed adjacent to the second ridge recess and recessed from the first body surface toward the second body surface; and each of the first and second connectors further comprises a second connecting piece coupled or formed with the first connecting piece, the second connecting piece comprising a first segment disposed at the first or second ridge recess and a second segment disposed at the first or second body recess.

10. The portable structure of claim 3, wherein a block is formed at a bottom of the first notch and comprises an interior block surface and a top block surface;

the first connecting piece of the first connector comprises a side wall abutting the interior block surface and fixedly coupled with the block.

11. The portable structure of claim 10, wherein the top block surface is dented toward the bottom of the first notch to accommodate the handle connecting piece of the first connector.

12. The portable structure of claim 3, wherein a block is formed at a bottom of the first notch, the block comprising an interior block surface and a top block surface;

the first connecting piece of the first connector is fixedly coupled with the block, the first connecting piece of the first connector comprising a first segment disposed on the top block surface and a second segment disposed beside the interior block surface of the block.

13. The portable structure of claim 12, wherein at least a portion of the first attachment portion of the handling is disposed between the first segment of the first connecting piece of the first connector and the top block surface of the block formed at the bottom of the first notch.

14. The portable structure of claim 12, wherein the first segment of the first connecting piece of the first connector is aligned substantially with a top ridge surface of the ridge adjacent to the first notch.

15. The portable structure of claim 12, wherein the first connector further comprises a second connecting piece coupled or formed with the first connecting piece, wherein the second connecting piece is fixedly coupled with the main body.

16. The portable structure of claim 15, wherein the second connecting piece of the first connector comprises:

a first segment formed or coupled with the first connecting piece of the first connector, and disposed on the first body surface of the main body; and a second segment extended from the first segment of the second connecting piece, wherein at least a portion of the second segment is disposed at a receptacle formed at the main body.

17. The portable structure of claim 1, wherein the ridge is formed with a notch, wherein the first connector is disposed at a first side of the notch and the second connector is disposed at a second side of the notch.

18. The portable structure of claim 17, wherein a first lug is formed at a first side of the notch, and a second lug is formed at a second side of the notch;

the first connecting piece of the first connector is formed with a first slot to receive the first lug, and fixedly coupled with the first lug;

the first connecting piece of the second connector is formed with a second slot to receive the second lug, and fixedly coupled with the second lug; and a connector bridge is disposed between the first and second connectors, the connector bridge coupled or formed with the first connecting pieces of the first and second connectors.

19. The portable structure of claim 18, wherein the handle connecting piece of the first connector is disposed between the first slot of the first connector and the connector bridge, and the handle connecting piece of the second connector is disposed between the second slot of the second connector and the connector bridge.

20. The portable structure of claim 18, wherein a first ridge recess is formed adjacent to the first lug and the first body surface of the main body, and recessed from the interior ridge surface toward the exterior ridge surface;

a second ridge recess is formed adjacent to the second lug and the first body surface of the main body, and recessed from recessed from the interior ridge surface toward the exterior ridge surface;

a first body recess is formed adjacent to the first ridge recess and recessed from the first body surface toward the second body surface;

a second body recess is formed adjacent to the second ridge recess and recessed from the first body surface toward the second body surface; and each of the first and second connectors further comprises a second connecting piece coupled or formed with the first connecting piece, the second connecting piece comprising a first segment disposed at the first or second ridge recess and a second segment disposed at the first or second body recess, wherein the second segment is fixedly coupled with the main body.

21. A portable structure comprising:

a main body having a first body surface and a second body surface;

a ridge coupled or formed with the main body and extended in a first direction beyond the first body surface;

a supporting assembly comprising a mounting bar disposed adjacent to the ridge;

first and second connectors, each comprising:

a first connecting piece connected to the ridge; and a second connecting piece coupled or formed with the first connecting piece, wherein the second connecting piece comprises a first segment disposed between the ridge and the mounting bar and a second segment disposed between the main body and the mounting bar, thereby cross-sectional-wise enclosing at least a portion of the mounting bar; and a handle comprising a first attachment portion connected to the first connector, a second attachment portion connected to the second connector, and a gripping portion between the first and second attachment portions to facilitate grasping of the handle.

22. The portable structure of claim 21, wherein the second connecting piece of each of the first and second connectors further comprises a third segment, wherein cross-sectional-wise, the first, second and third segments of the second connecting piece collectively form a substantial U-shape or a substantial arc shape to receive the mounting bar.

23. The portable structure of claim 21, wherein the ridge comprises an exterior ridge surface, an interior ridge surface spaced apart from the exterior ridge surface, a top ridge surface connecting the exterior and interior ridge surfaces;

the first connecting piece of each of the first and second connectors has a surface aligned with the top ridge surface;

the first segment of the second connecting piece of each of the first and second connectors is aligned with the interior ridge surface; and the second segment of the second connecting piece of each of the first and second connectors is aligned with the first body surface.

24. A portable structure comprising:

a main body having a first body surface and a second body surface;

a ridge coupled or formed with the main body and extended in a first direction beyond the first body surface;

first and second connectors, each comprising:

a first connecting piece connected to the ridge; and a second connecting piece coupled or formed with the first connecting piece, the second connecting piece comprising a first segment abutting the ridge and a second segment abutting the main body, wherein the second segment is fixedly coupled with the main body; and a handle comprising a first attachment portion connected to the first connector, a second attachment portion connected to the second connector, and a gripping portion between the first and second attachment portions to facilitate grasping of the handle.

25. The portable structure of claim 24, wherein the ridge is formed with first and second ridge recesses, each recessed from the interior ridge surface toward the exterior ridge surface to accommodate the first segment of the second connecting piece of the first or second connector such that the first segment of the second connecting piece is aligned with the interior surface of the ridge; and the main body is formed with first and second body recesses, each recessed from the first body surface toward the second body surface to accommodate the second segment of the second connecting piece of the first or second connector such that the second segment of the second connecting piece is aligned with the first body surface of the main body.

* * * * *